US006064838A

United States Patent [19]

Maruta et al.

[11] Patent Number: 6,064,838

[45] Date of Patent: May 16, 2000

[54] PRINTING SYSTEM THAT CAN IDENTIFY PRINTING COST BEFOREHAND

[75] Inventors: Syuji Maruta, Toyokawa; Yoshikazu Ikenoue; Eiko Hirano, both of Toyohashi, all of Japan

[73] Assignee: Minolta Co., Ltd., Osaka, Japan

[21] Appl. No.: 09/079,524

[22] Filed: May 15, 1998

[30] Foreign Application Priority Data

May 16, 1997 [JP] Japan ..... 9-143551
Dec. 3, 1997 [JP] Japan ..... 9-332809

[51] Int. Cl.[7] ..... G03G 21/02

[52] U.S. Cl. ..... 399/79; 399/8

[58] Field of Search ..... 399/8, 79, 81; 364/479.05, 479.08; 379/100.04; 395/200.33, 200.47, 200.48, 200.49

[56] References Cited

U.S. PATENT DOCUMENTS 5,132,915 7/1992 Goodman ..... 364/479.03
5,146,344 9/1992 Bennett et al. ..... 358/296
5,383,129 1/1995 Farrell ..... 364/464.01
5,459,552 10/1995 Ohira ..... 399/1
5,745,883 4/1998 Krist et al. ..... 705/34
5,850,584 12/1998 Robinson et al. ..... 399/79

FOREIGN PATENT DOCUMENTS 56-027162 3/1981 Japan .
59-116761 7/1984 Japan .
4-11547 1/1992 Japan .
8-190323 7/1996 Japan .

*Primary Examiner*—Robert Beatty
*Attorney, Agent, or Firm*—McDermott, Will & Emery

[57] ABSTRACT

A printing system includes an input unit for entering a printing job, a calculator for calculating copying cost according to the input printing job, a display for displaying the calculated copying cost, and a controller for allowing modification of a displayed printing job, and permitting a printing operation after confirming that there is no modification in the displayed printing job. The cost of a desired printing job can be displayed prior to a print out operation, so that modification of the printing mode is allowed. Since a print out operation is permitted after confirming the display of the copying cost, the expense required for printing can be identified in advance.

28 Claims, 35 Drawing Sheets

$$Wn=\sum_{n=\mu 1}^{255} \cdot h1(n) \qquad Sn=\sum_{n=\phi}^{255} \cdot h1(n)$$

$$Bn=\sum_{n=\phi}^{\mu 2} \cdot h1(n)$$

$$h3(n)=h1(n)-h2(n)$$

$$Cn=\sum_{n=b2}^{b1} \cdot h3(n)$$

(*) h1(n): INFORMATION OF HISTOGRAM MEMORY 1
h2(n): INFORMATION OF HISTOGRAM MEMORY 2

FIG.8A

INITIAL SCREEN

WELCOME

COST CALCULATION | START COPY

FIG.8B

INITIATE COST CALCULATION

COST CALCULATION

SET DOCUMENT AT DOCUMENT FEEDER,
AND DEPRESS START KEY.

FIG.8C

COST DISPLAY

THE COPY COST FOR
DOCUMENT IS
* * * YEN.

No
(MODIFY JOB)

OK

FIG.18

PD1

| NN | DC | JT | ST | RD | FM |
|---|---|---|---|---|---|
| NO | DATA CODE | DATE OF RECEPTION | DATE OF TRANSMISSION | RESERVATION DATE | PAYMENT FORM |

| DF | RI | ET | UC | PC |
|---|---|---|---|---|
| IMAGE FILE | RESERVATION DESIGNATED/NOT DESIGNATED | TIME UNTIL ERASURE | ID CODE | PRINT CONDITION |

FIG.19

| No | DF IMAGE FILE | DC DATA CODE | UC ID CODE | PC PRINT CONDITION |
|---|---|---|---|---|
| 1 | A | 111 | 1234 | a |
| | B | 222 | | b |
| | C | 333 | | c |
| 2 | D | 444 | 1235 | d |
| 3 | E | 555 | 1236 | e |
| | F | 666 | | f |
| 4 | G | 777 | 1237 | |
| | H | 888 | | |
| | | | | |

FIG.20

| PATTERN | NUMBER OF PRINTS | OUTPUT COLOR | DUPLEX OUTPUT | STAPLE | PUNCH | SHEET SIZE | PICTURE QUALITY |
|---|---|---|---|---|---|---|---|
| a | 1 | MONOCHROMATIC | ONE-SIDE PRINTING | DESIGNATED | DESIGNATED | A4 | AT LEAST 600 DPI |
| b | 3 | COLOR | ONE-SIDE PRINTING | NOT DESIGNATED | NOT DESIGNATED | A3 | AT LEAST 400 DPI |
| c | 2 | COLOR | ONE-SIDE PRINTING | NOT DESIGNATED | NOT DESIGNATED | B5 | AT LEAST 400 DPI |
| d | 6 | MONOCHROMATIC | ONE-SIDE PRINTING | NOT DESIGNATED | NOT DESIGNATED | A4 | NOT DESIGNATED |
| e | 5 | MONOCHROMATIC | TWO-SIDE PRINTING | DESIGNATED | NOT DESIGNATED | A4 | NOT DESIGNATED |
| f | 1 | MONOCHROMATIC | TWO-SIDE PRINTING | DESIGNATED | DESIGNATED | B4 | AT LEAST 600 DPI |
| • | • | • | • | • | • | • | • |
| • | • | • | • | • | • | • | • |
| • | • | • | • | • | • | • | • |
| • | • | • | • | • | • | • | • |
| • | • | • | • | • | • | • | • |

FIG.23

| MACHINE NAME | INSTALLED SITE | COLOR ACCOMMODATION | PICTURE QUALITY | SIZE OF INSTALLED SHEET | RANGE OF CORRESPONDING MAGNIFICATION | DUPLEX COPY ACCOMMODATION | OUTPUT SPEED |
|---|---|---|---|---|---|---|---|
| XXXXX | XXX | MONOCHROMATIC MACHINE | 400DPI | A3・A4・B4 | 0.25～4.0 | YES | 10 SHEETS/MINUTE |
| YYYYY | YYY | COLOR MACHINE | 400DPI | A4・B4 | 0.25～4.0 | NO | 3 SHEETS/MINUTE |
| ZZZZZ | ZZZ | MONOCHROMATIC MACHINE | 600DPI | A4 | 0.25～4.0 | NO | 20 SHEETS/MINUTE |
| AAAAA | AAA | MONOCHROMATIC MACHINE | 400DPI | A4・A4 (CARDBOARD) | 0.5～2.0 | NO | 12 SHEETS/MINUTE |
| ・ | ・ | ・ | ・ | ・ | ・ | ・ | ・ |
| ・ | ・ | ・ | ・ | ・ | ・ | ・ | ・ |

| PUNCH | STAPLE | MONOCHROMATIC UNIT COST | COLOR UNIT COST | PRINTING COST |
|---|---|---|---|---|
| DESIGNATED | DESIGNATED | 10 YEN | ——— | 600 YEN |
| NOT DESIGNATED | NOT DESIGNATED | 15 YEN | 50 YEN | 2000 YEN |
| NOT DESIGNATED | DESIGNATED | 20 YEN | ——— | 1200 YEN |
| NOT DESIGNATED | NOT DESIGNATED | 8 YEN/30 YEN (CARDBOARD) | ——— | 500 YEN |
| ・ | ・ | ・ | ・ | ・ |
| ・ | ・ | ・ | ・ | ・ |

PRINTING SYSTEM THAT CAN IDENTIFY PRINTING COST BEFOREHAND

This application is based on Japanese Patent Application Nos. 9-143551 and 9-332809 filed in Japan, the contents of which are hereby incorporated by reference.

BACKGROUND OF THE INVENTION

1. Field of the Invention

The present invention relates to a stand-alone or network-connected printing system. More particularly, the present invention relates to a printing system that can identify the printing cost in advance.

2. Description of the Related Art

The art of interest to the present invention for counting the number of copies to calculate the copying expense is disclosed in, for example, Japanese Patent Publication No. 3-52626 and Japanese Patent Laying-Open No. 56-27162. The technique of detecting termination of a copy operation to calculate and display the copy rate from the "number of copies×unit cost" is disclosed in Japanese Utility Model Laying-Open No. 4-11547.

There are times when the expense of a desired copy job is to be identified before actually carrying out a copy operation. The copy rate is calculated as "number of copies× unit cost". This "unit cost" depends on various conditions such as the size of the recording sheet and full color/two-color/black-and-white mode. The size of a recording sheet is determined according to the size of the original document and the magnification rate. Since the calculation of the total fee of copies taken in various modes from various documents is complicated, it is difficult to confirm in advance whether the copy fee is within an intended amount of cost or not. It is desired to easily identify in advance the cost of a specific copy job.

It is also desirable to be able to alter the mode (for example, alter the copy mode from full color mode to black-and-white mode, or alter the magnification rate to reduce the size of the recording sheet) when identification is made that the intended account is exceeded after setting a copy job. Accordingly, an intended amount of cost can be satisfied.

In accordance with the spread of personal computer communication and image softwares, the user of a personal computer can provide a display of various types of images easily on the screen of his/her own display device at home. It is easy to print out such images on a recording sheet by virtue of improvement in the printer's performance and reduction in cost.

However, a printer of high performance that provides a printout on a large-sized sheet with the picture quality of a color image approximating that of a silver halide photograph is yet too expensive for a general user to own.

A printing system is proposed that allows printout of a high quality even for users that do not posses their own exclusive color printer of high performance. In this printing system, the personal computer of a user is connected to a color printer of high performance via a communication line. Each user shares the usage of the connected color printer.

FIG. 43 is a schematic block diagram of a conventional printing system 800.

Referring to FIG. 43, a printing system 800 includes personal computers 802*a*–802*c* of respective users, a color printer 804 of high performance, a printer controller 805 for providing control of color printer 804, a display 803 associated with printer controller 805, and a communication line 806. Each of personal computers 802*a*–802*c* is installed at the home of respective users. Color printer 804 and printer controller 805 are installed at an appropriate site, such as in a convenience store.

When a user wants to obtain a printout, the user enters an image file DFa into a personal computer 802*a*, for example, and also a print reservation instruction and user name at the same time.

In response, personal computer 802*a* assigns an image file number 903*a* for the input image file DFa, and transmits the same together with the user name as a header file 902*a* to printer controller 805 and color printer 804. Therefore, header files 902*a*–902*c* transmitted from various users are accumulated in printer controller 805 and color printer 804. At this time point, image file DFa is not yet transmitted.

The user then goes to the convenience store where printer controller 805 and color printer 804 are installed to instruct execution of a printout operation. On the screen of display 803 of printer controller 805, a plurality of image file numbers 903*a*–903*c* and associated user names sent from respective users are provided.

The user searches for his/her own user name and image file number 903*a* to enter a print execution instruction with respect to the appropriate image file number 903*a*. In response, image file DFa is transmitted from personal computer 802*a* to color printer 804 to be stored in a memory 807 of printer 804. The user sets the appropriate printing conditions such as the sheet size, resolution of picture quality, the number of copies, and the like for color printer 804. The cost required for the printing operation is determined, and then a printing operation is executed.

In the above-described conventional printing system 800, the user had to take the trouble of going to the installed site of color printer 804 and then set the printout conditions for color printer 804. The user can identify the expense corresponding to a printout execution only after setting various printing out conditions for color printer 804.

In other words, some time is required before the user obtains a printout of a desired image after going to the installation site of color printer 804. Furthermore, the user cannot identify the expense information required for printout before coming to the installed site of color printer 804.

SUMMARY OF THE INVENTION

In view of the foregoing, an object of the present invention is to provide a printing system that can identify the expense of a desired printout job prior to a printing out operation.

Another object of the present invention is to provide a printing system that allows the printing mode to be altered so as to satisfy an intended amount of cost when the expense for a printing out job exceeds the intended amount.

A further object of the present invention is to provide a printing system that can execute a printing out job after confirming that an intended amount of cost is satisfied when the cost for a printing out job is predetermined.

Still another object of the present invention is to provide a printing system connected to a network including a printer apparatus that is network-connected to a user side data processor that allows the user to obtain, at the user side data processor, information of expense required for a print out before the user goes to the installed site of the printer apparatus.

A still further object of the present invention is to provide a printing method that allows expense of a desired printing out job to be identified prior to the printing out job.

Yet a further object of the present invention is to provide a printing method that allows a printing out job to be carried out after confirmation of an intended amount of cost being satisfied when the cost for a printing out job is predetermined.

Yet another object of the present invention is to provide a printing method of a printing system connected to a network including a printer apparatus networkconnected to a user's terminal that allows the user to obtain, at the user's terminal, information of expense required for a print out before the user goes to the installed site of the printer apparatus.

The above objects of the present invention can be accomplished by a printing system including elements set forth in the following.

According to an aspect of the present invention, a printing system includes an input unit for entering a print job, a calculation unit for calculating a printing cost according to an input printing job, a display for providing a display of the calculated printing cost, and a controller allowing modification of the displayed printing job, and permitting a printing operation after confirming that there is no modification in the displayed printing job.

According to the present invention, the printing cost is calculated and displayed according to an input printing job. Since modification of the displayed printing job is allowed and a printing operation is permitted after confirming that there is no modification, the expense of the desired copy job can be identified prior to execution of the printing operation. The mode can be altered so as to satisfy a predetermined amount of cost. A copy operation can be initiated after confirming that a predetermined amount is satisfied.

According to another aspect of the present invention, a printing system includes a user side data processor for sending a data file that the user wishes to print out, a center side data processor connected to the user side data processor through a communication line, and having a memory for storing the data file sent from the user side data processor, and a printer connected to the center side data processor for printing out the data file sent from the center side data processor.

The printer includes a first printing cost information transmitter for transmitting printing cost information which is the information of expense corresponding to execution of printing out the data file to the center side data processor prior to execution of printing out the data file.

The center side data processor includes a second printing cost information transmitter for transmitting the printing cost information from the printer to the user side data processor.

The user side data processor, the center side data processor, and the printer are connected via a communication line. The printer sends the information of expense required for printout execution to the user side data processor prior to execution of the printing operation. As a result, the user can obtain, at the user side data processor prior to going to the installed site of the printer apparatus, information of expense required for printing by the printer apparatus that is network-connected to the user side data processor.

According to a further aspect of the present invention, a printing system includes a user side data processor for transmitting a data file of which the user wishes to print out, a center side data processor connected to the user side data processor through a communication line, and having a memory for storing the data file transmitted from the user side data processor, and a printer connected to the center side processor for printing out the data file sent from the center side data processor.

The center side data processor includes a printing cost calculation unit for calculating printing cost information which is the information of expense corresponding to a printout execution of a data file prior to print out thereof, and a printing cost information transmitter for transmitting the printing cost information to the user side data processor.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 8A–8C are diagrams showing a display of a liquid crystal panel in FIGS. 7A and 7B.

FIG. 18 shows an example of a structure of image printing information stored in a center side data processor.

FIG. 19 is a diagram for describing the relationship of data code, ID code, and the printing condition.

FIG. 20 shows various items of the printing condition.

FIG. 23 shows the contents of copy machine information.

DESCRIPTION OF THE PREFERRED EMBODIMENTS

First Embodiment

Figure 1:
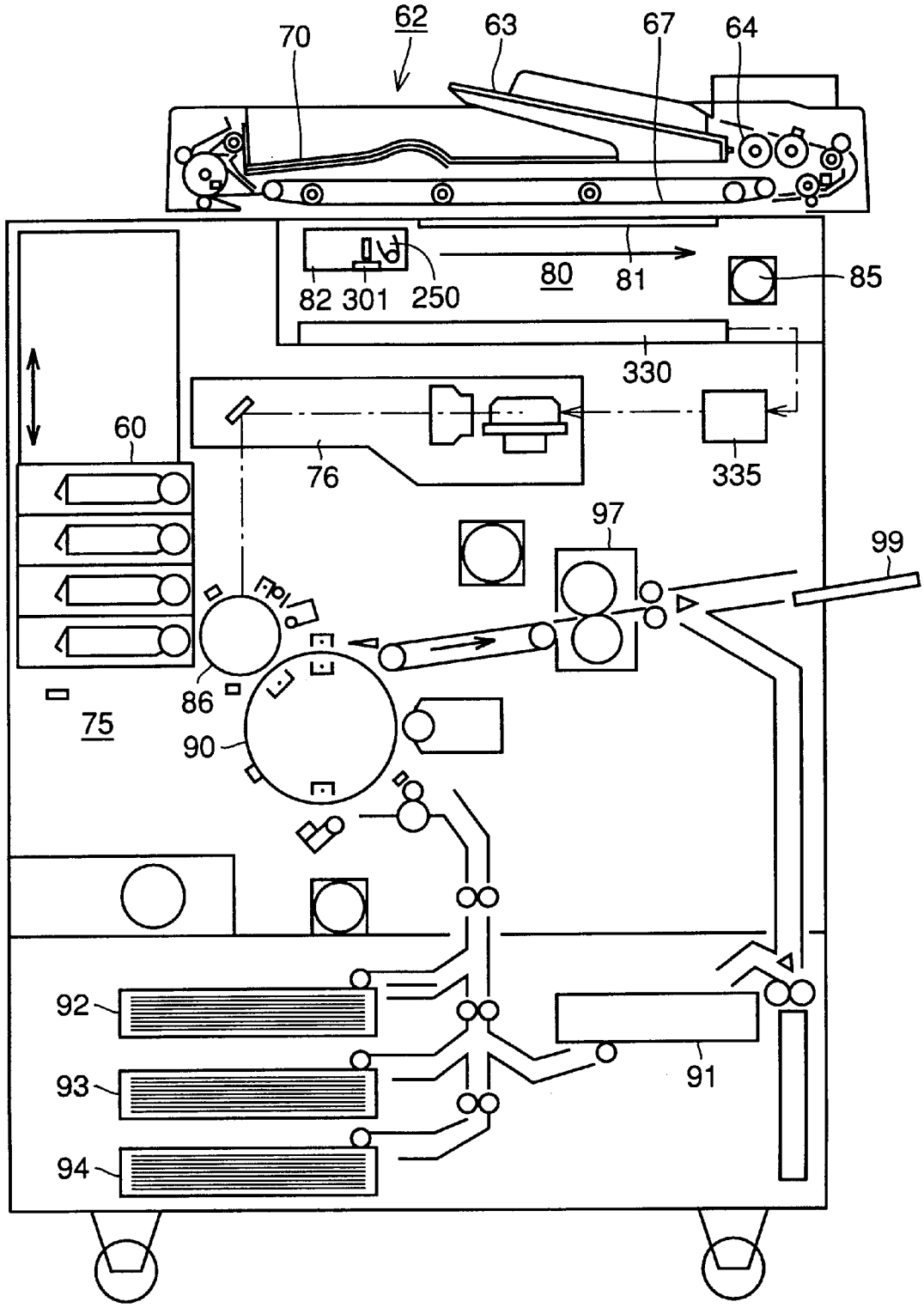
FIG. 1 is a center cross sectional view schematically showing the entire structure of a copy machine according to a first embodiment of the present invention.

Referring to FIG. 1, a copy machine forming the printing system in which the present invention is applied is a electronic photographic digital color copy machine employing laser exposure. An automatic document feeder 2 is provided on a glass platen 81. The copy machine of this system is well known, and the mechanism will be described only briefly hereinafter.

1. Mechanism and operation of copy machine

A document set on a document tray 63 of automatic document feeder 62 is fed leftwards in the drawing one by one through a sheet feed roller 64 and a transportation belt 67 that are operated in response to a start key 642 turned on in the operation panel (FIG. 7A) of the copy machine. As a result, the document is set on glass platen 81 of the copy machine. This completion of setting can be determined by a detection signal of a sensor not shown or according to the elapse of time and the feeding speed from a detected time point. When the setting is completed, a document reader 30 is operated to read out the document. When termination of a reading operation is notified through a relevant signal from document reader 30 to a CPU 410 (FIG. 7B), the read out document is conveyed leftwards in the drawing by transportation belt 67 to be discharged out on a discharge tray 70. The feed, set, and discharge operation of the document is repeated until there are no more documents on document tray 63. The presence of a document on document tray 63 is detected by a sensor not shown and signaled to CPU 410.

When a document is set on glass platen 81 by automatic document feeder 62, image reader 80 has the document scanned by a scanner 82 that is moved by the driving force of a pulse motor 85. A reflected image is converted photoelectrically by a CCD (line image sensor) 301. The obtained image signals of R, G and B are converted into image data for laser exposure by an image signal processor 330 and stored in a buffer memory 335. The process carried out by image signal processor 330 will be described afterwards.

At an image recorder 75, electrophotographic image recording by laser exposure is carried out.

First, a laser device 76 is driven according to the image data from buffer memory 335 to output a laser beam modulated by the image data. The rotary charged surface of a photoconductor drum 86 is scanned in the direction of the shaft by the laser beam. An electrostatic latent image corresponding to the image data is formed. This electrostatic latent image is toner-developed by any of the toner developing units (any developing unit of magenta M, cyan C, yellow Y and black Bk) provided in an elevating manner within developing unit 60.

In a full color mode, an electrostatic latent image corresponding to each color is sequentially formed and developed to be transferred (details provided afterwards). This operation is carried out for four times in total.

The visible image subjected to toner development on the surface of photoconductor drum 86 is transferred onto a recording sheet on the surface of a transfer drum 90 that is rotated in synchronization with photoconductor drum 86. In the case of a full color mode, the visible images corresponding to the toner of four colors are transferred in an overlaid manner on the same recording sheet. The toner images are sequentially overlaid by a total of four operations. A recording sheet of a selected size is fed at a predetermined timing from an appropriate one of sheet feed trays 92–94 or from a sheet refeed tray 91 and wound around transfer drum 90.

When the transfer of the toner images is completed (transfer of four colors when in a full color mode), the recording sheet is detached from transfer drum 90 to be sent to a fixation device 97 to be subjected to an image fixation process by thermal compression through fixation device 97 and then discharged to discharge tray 99. In the case where a further image recording operation is to be carried out on the same recording sheet in the duplex copy mode, the recording sheet subjected to an image fixation process is sent to sheet refeed tray 91, not to discharge tray 99, and fed again at a predetermined timing for a further image recording process.

2. Process at image signal processor 330

Figure 2:
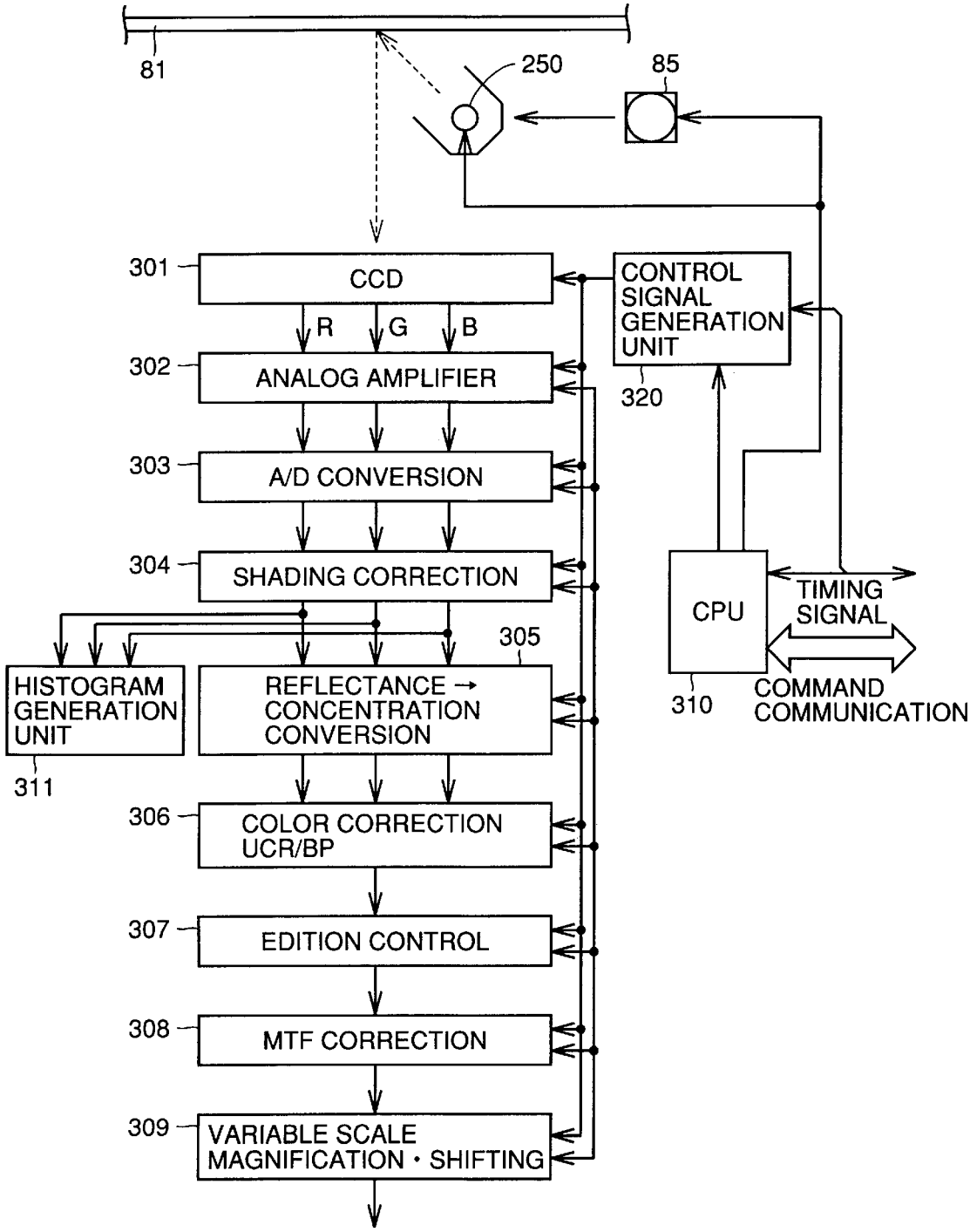
FIG. 2 is a block diagram showing an image signal process of the copy machine of FIG. 1.
Figure 3:
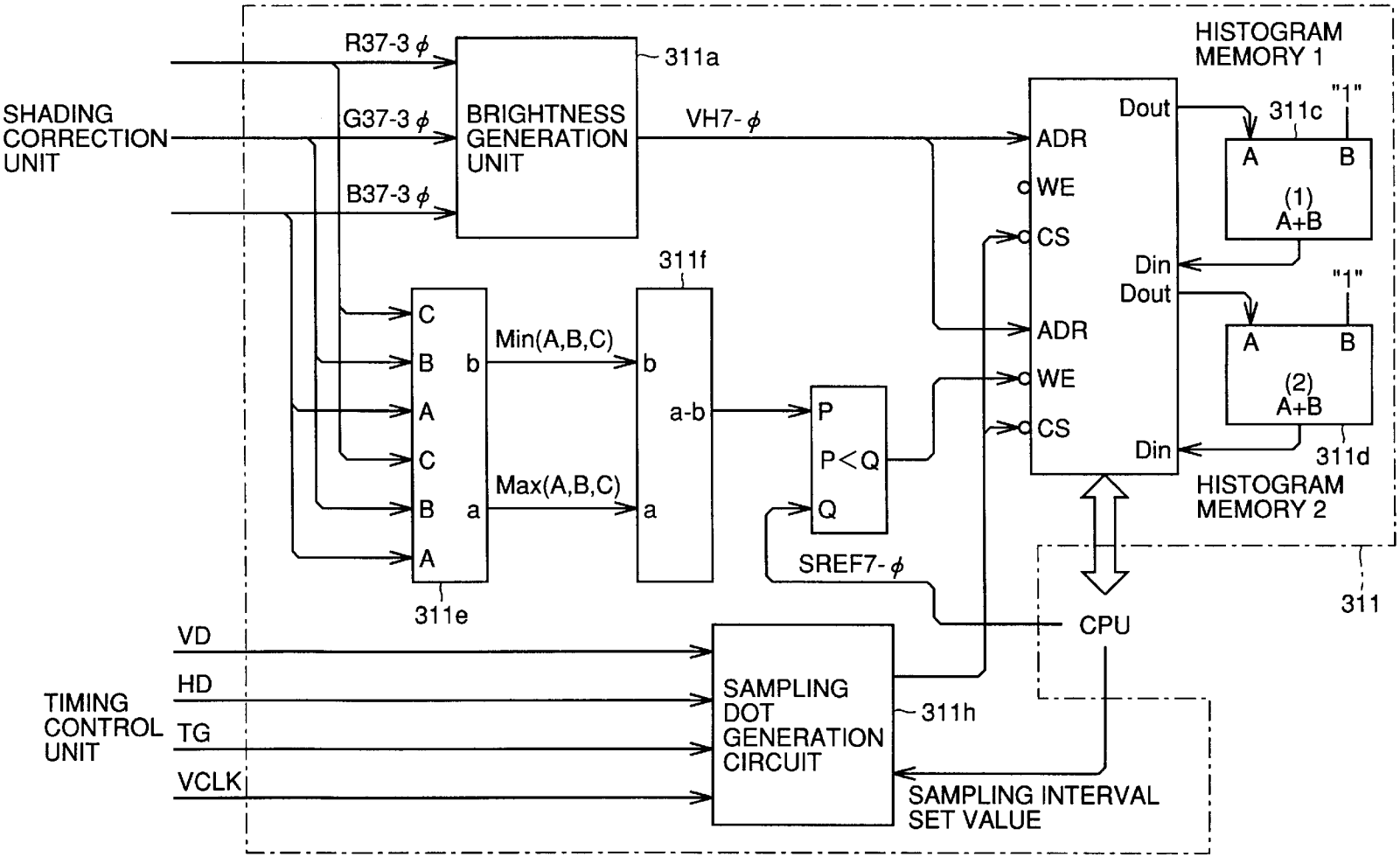
FIG. 3 is a block diagram showing a histogram generation unit in FIG. 2.
Figure 7A:
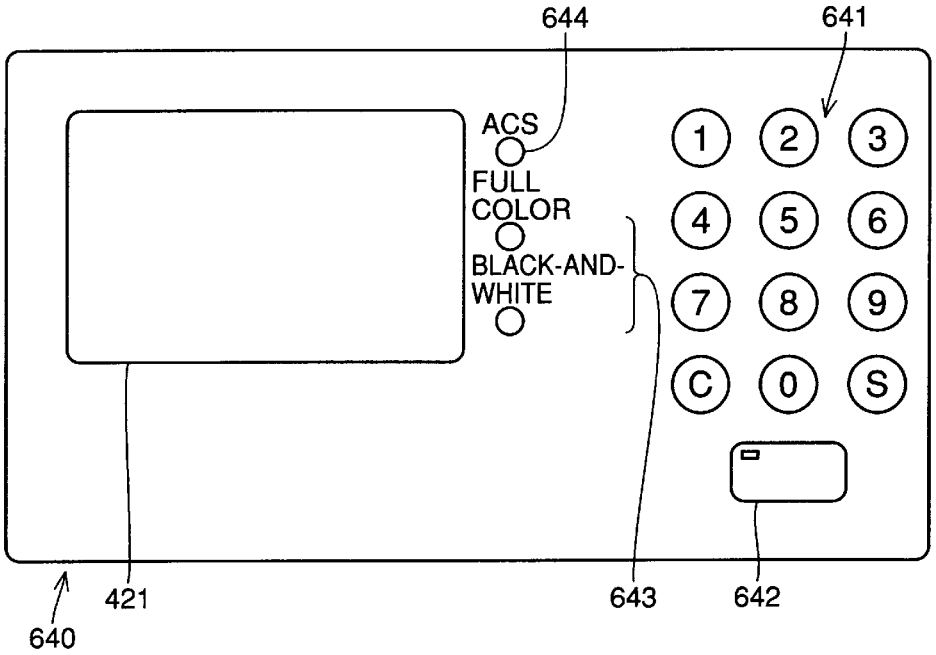
FIG. 7A is a diagram for describing an operation panel.
Figure 7B:
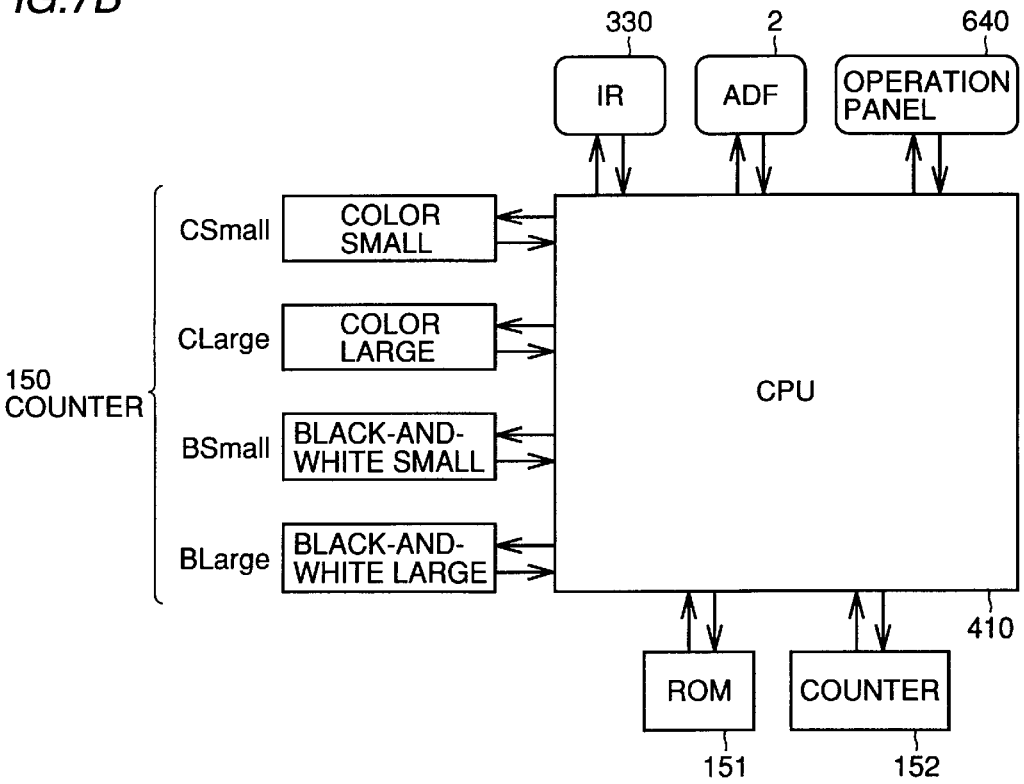
FIG. 7B is a block diagram showing the signal input/output of a control CPU of a copy machine.

The process carried out by image signal processor 330 will be described with reference to FIG. 2. Each block in image signal processor 330 operates according to a signal (drive pulse and the like) from a control signal generation unit 320 and the operation parameters sent from CPU 310. CPU 310 operates according to the command communication with CPU 410 (refer to FIG. 7B) that provides the overall control of the copy machine. The type of command from CPU 410 corresponds to the mode specified by the user through operation panel 640 (FIG. 7A).

Each image signal of R, G, and B (red, green and blue) generated by photoelectric conversion at CCD 301 is first sent to an analog amplifier·S/H (Sample Hold) process block 302 to be amplified and sample-held. Then, the signal is sent to an A/D conversion block 303 to be converted into digital image data.

Each digital data of R, G, and B output from A/D conversion block 303 is provided to a shading correction block 304 to have unevenness in the amount of light of exposure lamp 250 and variation in sensitivity for each pixel of CCD 301 amended (shading corrected). The digital image data subjected to a shading correction is sent to a reflectance→concentration conversion block 305. In the case of a pre-scan operation for detecting the document size or for an ACS process (described afterwards), the data is sent to a histogram generation unit 311. The process carried out by histogram generation unit 311 will be described afterwards.

Each image data (reflectance data) applied to reflectance→concentration conversion block 305 is converted into image data (concentration data) of r, g and b. Also, the data is subjected to a tone reproduction process such as highlight area enhancement and shadow area enhancement. Each process up to reflectance→concentration conversion block 305 is carried out in parallel for each image data of R, G, and B.

Each image data of r, g, and b (concentration data) output from reflectance→concentration conversion block 305 are applied to a color correction·UCR/BP process block 306. Here, image data of the three colors of r, g and b are combined, whereby print data of Y, M, C and Bk are output. CPU 310 provides control of which color of print data is to be combined and output. CPU 310 is in synchronization with image recording unit 20.

Print data of Y, M, C and Bk sequentially output from color correction UCR/BP process block 306 is subjected to an edit process such as trimming, if necessary, at an edit control block 307. The data is then sent to a MTF correction block 308 to be subjected to the edge enhancement and smoothing processes. The data is further sent to a variable scale magnification·shift process block 309 to be subjected to a pixel density conversion process or pixel shift process in the direction of the main scan, or an repetitive output process of the same region (called "image repeat"), and then output to buffer memory 335.

3. ACS process

An ACS process carried out at histogram generation unit 311 will be described with reference to FIGS. 3–6. An ACS process serves to identify whether the document set on glass platen 81 is a black-and-white document or a color document to determined the copy mode.

Identification of a black-and-white document/color document is made on the basis of whether the ratio of the number of chromatic dots Cn sampled from a document size region with respect to the total number of dots Sn sampled from the same region is smaller or not than a predetermined value SREF7-ϕ provided from CPU 310. This identification is carried out by the following process.

A pre-scanning operation is initiated by image reader 80 in response to turning on start key 642 on the operation panel (FIG. 7A) of the copy machine. Each image data R37-3ϕ, G37-3ϕ, B37-3ϕ of each read out R, G and B are sent to histogram generation unit 311.

In histogram generation unit 311*a*, brightness data VH7-ϕ is generated by a brightness generation unit 211*a* from each of image data R37-3ϕ, G37-3ϕ, and B37-3ϕ of R, G and B. This brightness data VH7-ϕ is input as each address into a histogram memory (1) 311*c* and a histogram memory (2) 311*d*.

Figure 4:
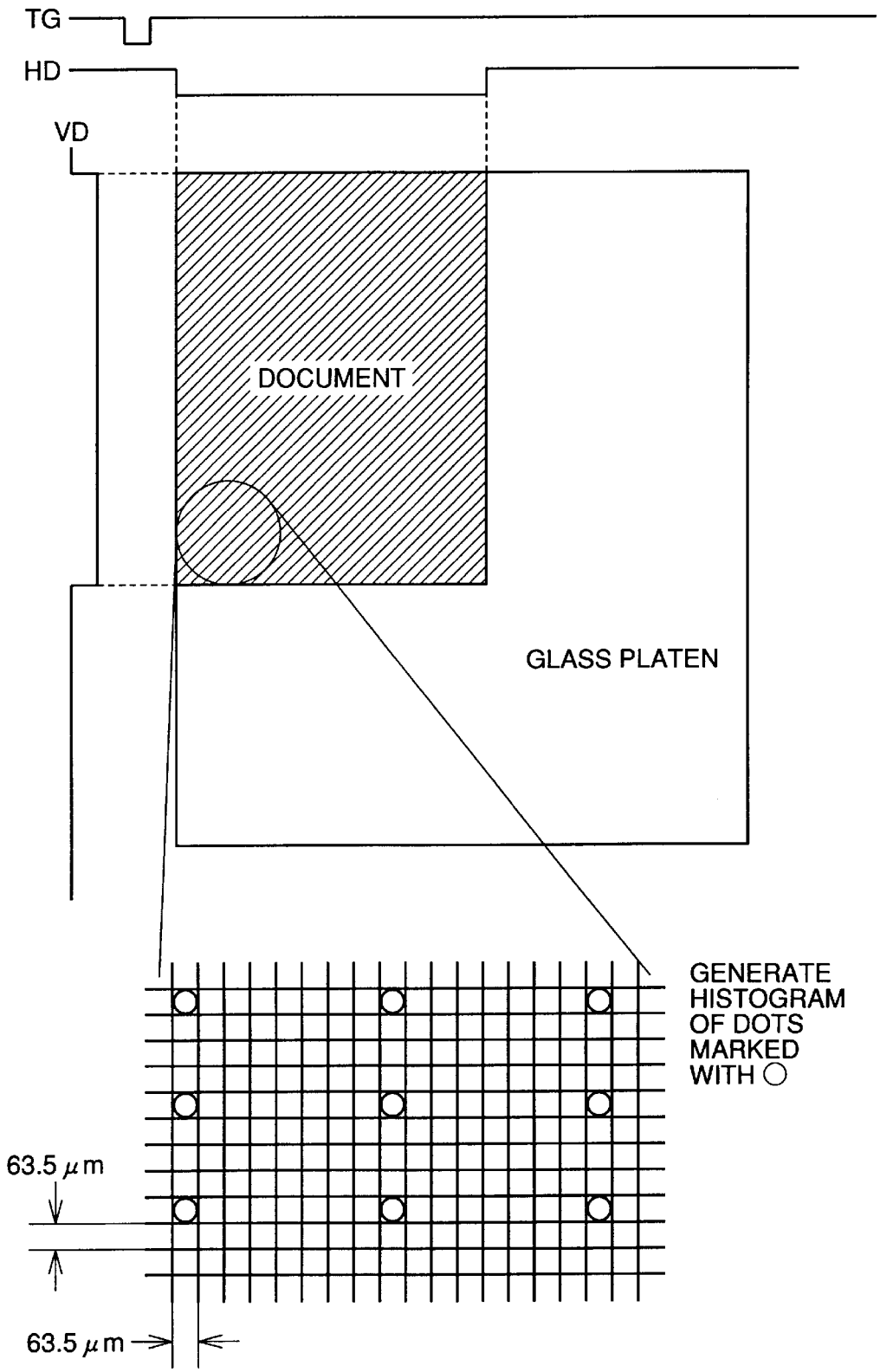
FIG. 4 is a diagram for describing sampling of pixels for generating a histogram.
Figure 6:
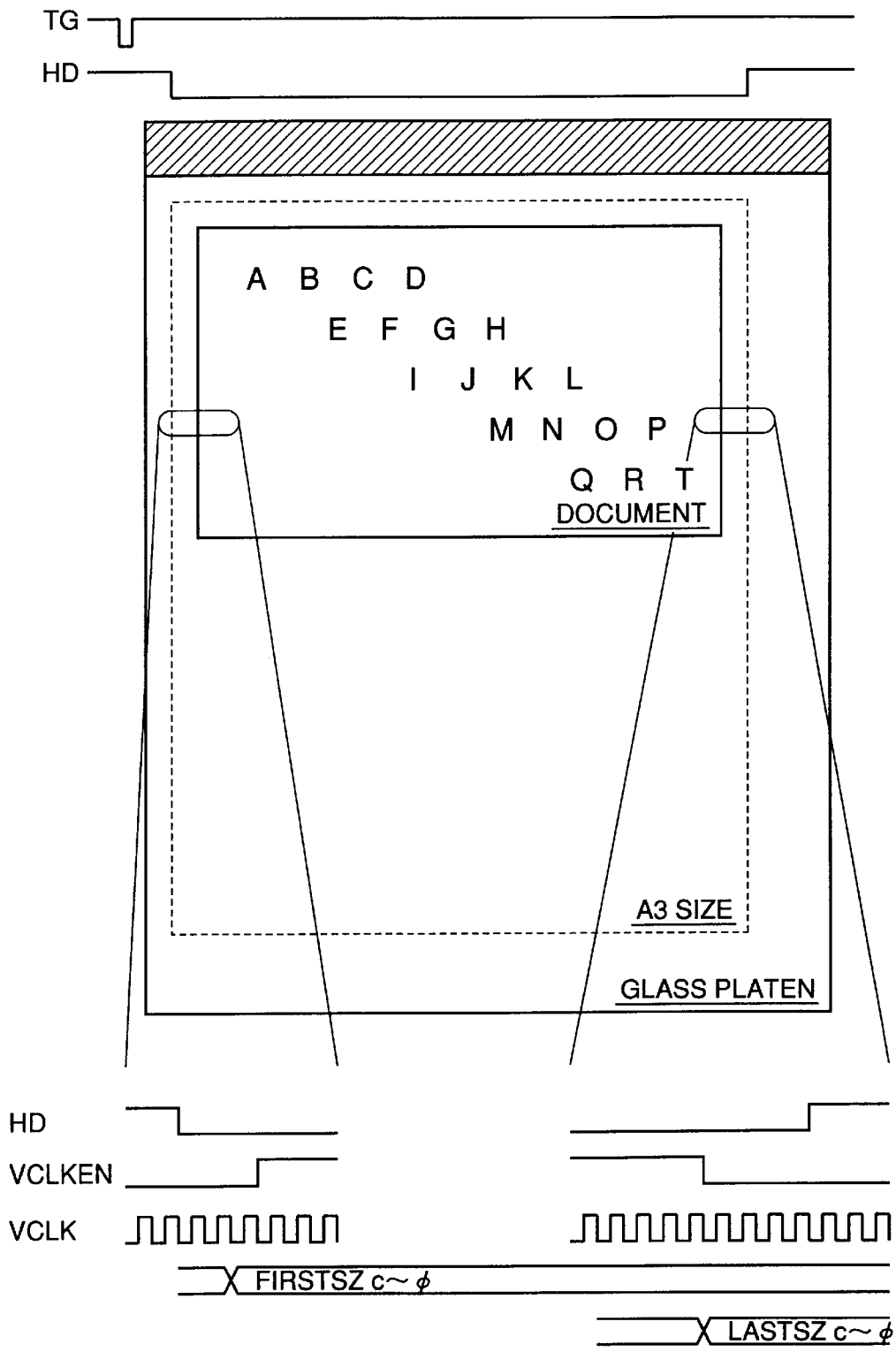
FIG. 6 is a diagram for describing the method of detecting the document size.

It is to be noted that brightness data VH7-ϕ applied as an address into each of histogram memories 311*c* and 311*d* is not the brightness for all the dots in the document size region, but the brightness of the dots specified by a sampling dot generation circuit 311*h*. In the present example, decimation of ⅛ and ¼ is effected in the main scanning direction and the sub-scanning direction, respectively, as shown in FIG. 4 taking into consideration the capacity of the memory. Accordingly, the capacity of 1M bit is sufficient in contrast to the requirement of the maximum capacity of 32M bits when all the dots are input in A3-size. Sampling dot generation circuit 311*h* carries out such decimation according to the sampling interval set value from CPU 310. Also, the above sampling is made valid in the document size region according to signals HD and VD indicating the document size in the main scanning direction and the subscanning direction, respectively. Here, signals HD and VD indicating the document size are generated as shown in FIG. 6 by detecting the background level of the document from a signal obtained by pre-scanning according to the conventionally well known method. Signals HD and VD are applied to sampling dot generation circuit 311*h*. In the drawing, TG indicates a main scanning synchronizing signal, and VCLK is a synchronizing clock of the image data.

Brightness data VH7-ϕ is applied to histogram memory (2) 311*d* only when the color is achromatic. Therefore, the minimum value Min (A, B, C) and maximum value Max (A, B, C) are obtained from each of image data R37-ϕ, G37-3ϕ, and B37-3ϕ of R, G and B by a maximum-minimum calculation unit 311*e*. Then, the difference therebetween (a–b) is obtained by a difference calculation unit 311*f*. When this difference (a–b) is smaller than a predetermined value SREF7-ϕ from CPU 210 (P<Q), input to histogram memory (2) 311*d* is effected. In other words, achromatic color is defined as described above taking advantage that the difference between the maximum value and the minimum value of the R, G and B image data is small.

The data of the input address in each of histogram memories 311*b* and 311*c* to which brightness data VH7-ϕ is applied is read out and added by "1", and then written into the relevant address. The operation of the histogram memory attains a read modify cycle with 8 dots as one cycle. Therefore, the address of histogram memories 311*b* and 311*c* indicates the gray scale level. The data stored in each address indicates the frequency (numbers) of the gray scale level corresponding to the relevant address.

Figure 10:
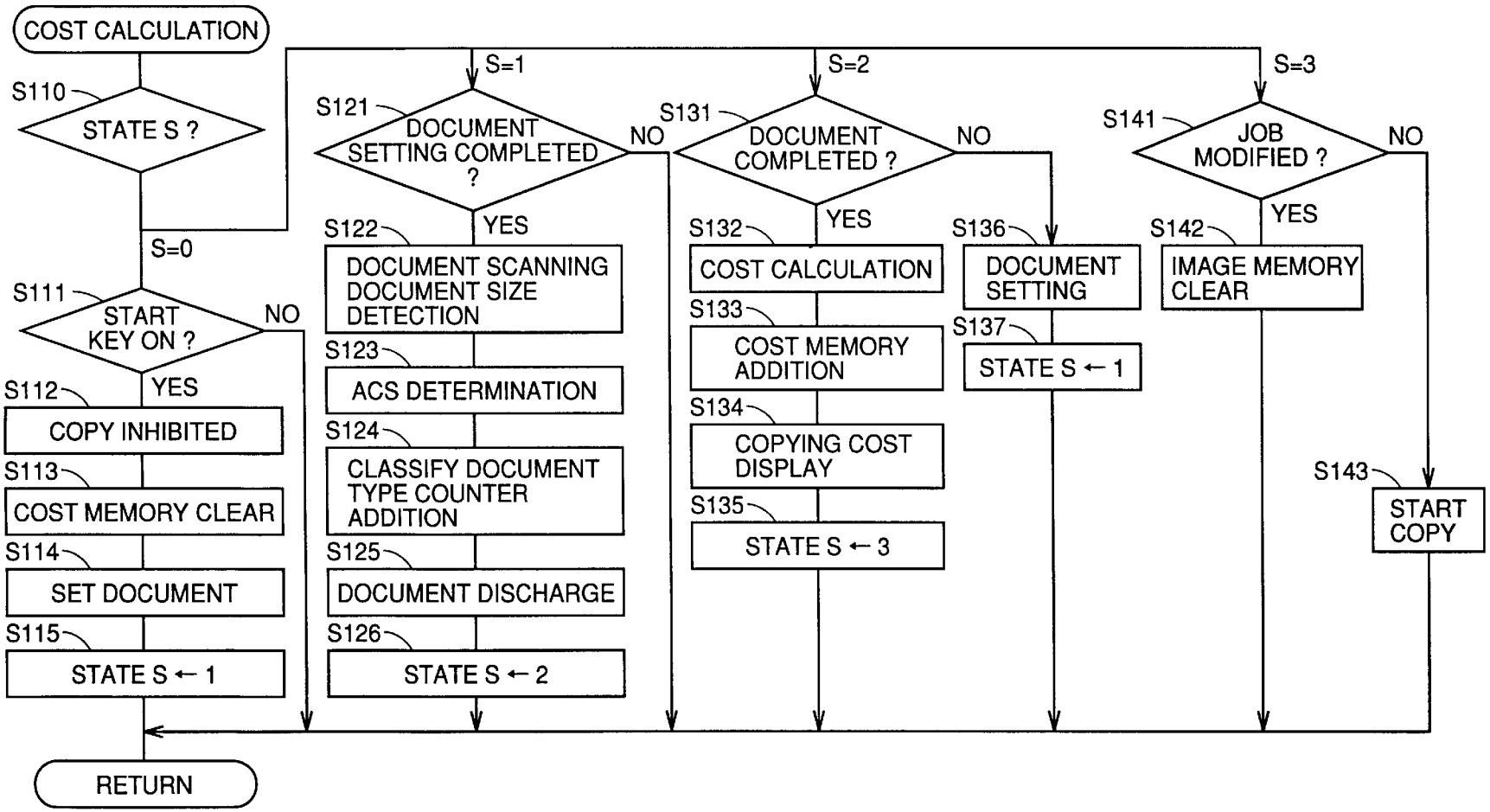
FIG. 10 is a flow chart showing the cost calculation process of FIG. 9.

Upon completion of the pre-scanning operation, CPU 310 reads out the frequency data for each gray scale from histogram memories 311*c* and 311*d*. The read out data is sent to CPU 410. The ACS determination process of step S123 in FIG. 10 is carried out according to the frequency data. Following read out of frequency data, 00000 is written into the address of all gray scale levels 0–255 in histogram memories 311*c* and 311*d*.

Figure 5:
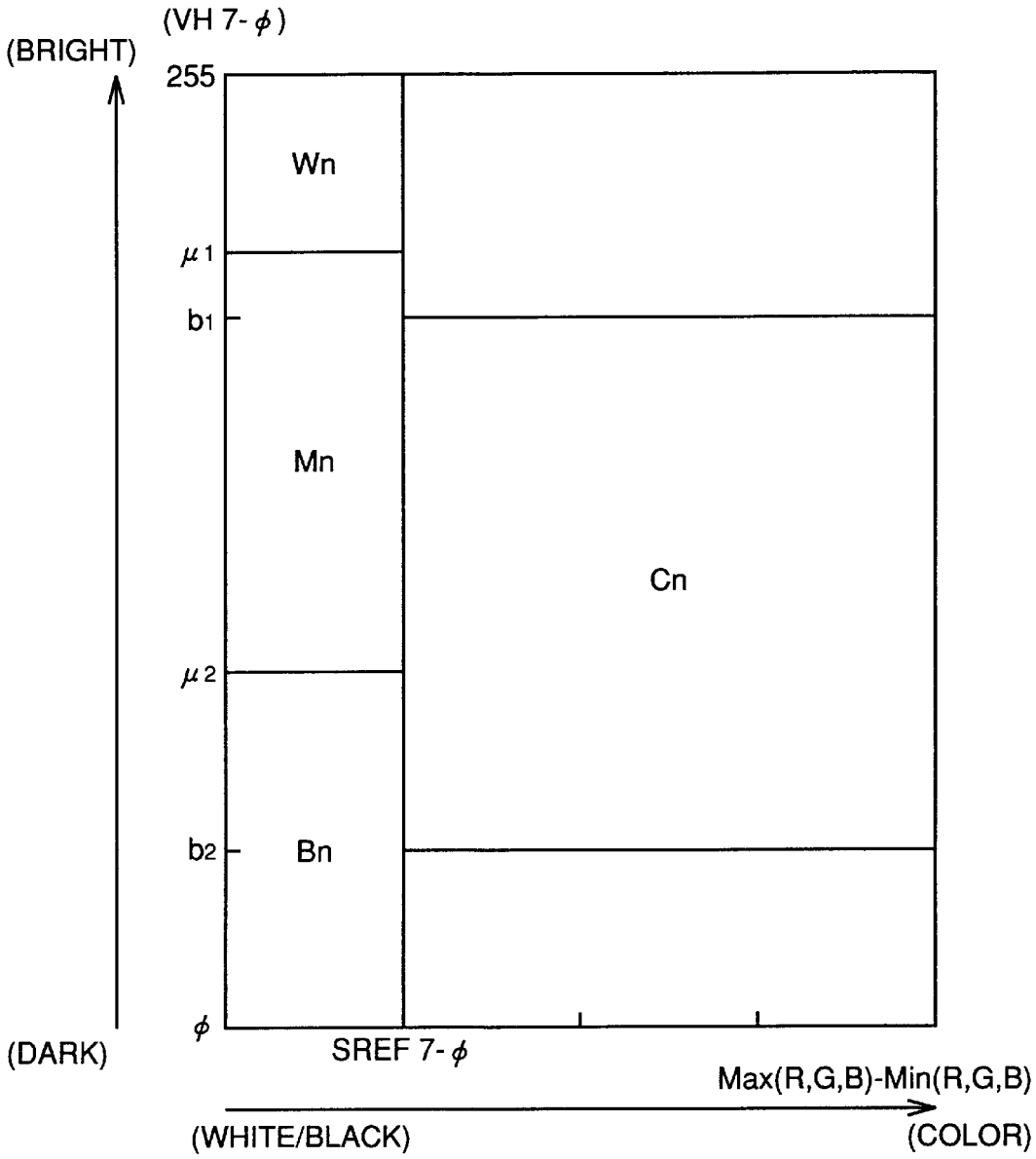
FIG. 5 is a diagram for describing an ACS (Auto Color Select) process.

In the ACS determination process, the frequency (h2(n)) corresponding to histogram 2 is subtracted from each frequency (h1(n)) of histogram 1 to be set as histogram 3 (h3(n)). This histogram 3(h3(n)) corresponds to the chromatic color area of the document. Then, the sum of the frequency in the gray scale range of $b_2$–$b_1$ out of histogram 3 (h3(n)) is obtained and substituted into Cn (refer to FIG. 5). Cn is a variable indicating the number of dots in the color region. The number of dots in the gray scale range of 0–255=total sum is obtained out of each frequency (h1(n)) of histogram 1 and substituted into Sn. Sn is the sum of the total frequency of histogram 1=the total number of pixels in the document. In FIG. 5, Wn is the number of dots in the background (white) region of the document, Mn the number of dots in the halftone (gray) region of black-and-white in the document, and Bn is the number of dots in the black region in the document.

Upon obtaining Cn and Sn, the ratio Cn/Sn is compared with a certain threshold value. When the ratio is equal to or smaller than the threshold value, determination is made of a black-and-white document, so that the black-and-white copy mode is selected. When the ratio is greater than the threshold value, determination is made of a color document, and the full color copy mode is selected. By employing Sn as the denominator, the effect of the document size can be neglected. It is assumed that an appropriate value for the above "certain threshold value" is maintained in CPU 41.

4. Cost calculation

Cost calculation will be described hereinafter with reference to FIGS. 7A–10. Cost calculation is based on the type of document corresponding to the defined document size (large/small) and ACS determination result (black-and-white/color), and the number of documents for each type.

A counter (color small, color large, black-and-white small, black-and-white large) 150 that corresponds to each type of document determined by the combination of the document size (large/small) and the ACS determination result (black-and-white/color) is connected to CPU 410 (refer to FIG. 7B) that provides the overall control of the copy machine. The count value of the counter corresponding to each type of document is incremented every time a relevant document is read by a pre-scanning operation. When the pre-scanning operation for all the documents is completed, the corresponding unit cost is multiplied by the count value of each counter and the total sum thereof obtained. The total sum is displayed as shown in FIG. 8C on a liquid crystal panel 421 in operation panel 640. The user can identify the cost of a desired copy job beforehand to decide whether to modify the job or to initiate the intact copy job.

The display shown in FIG. 8A is initially provided on liquid crystal panel 421. Depression of "cost calculation" button causes a message to be displayed that promotes document setting and depression of start key 642. Upon setting the document on document tray 3 and turning on start key 642, the pre-scanning operation is initiated to identify the type of each document (color small, color large, black-and-white small, black-and-white large). The relevant counter is incremented and the above-described calculation is effected when the pre-scanning operation for all the documents is completed. As a result, the display as shown in FIGS. 8C is provided.

Figure 9:
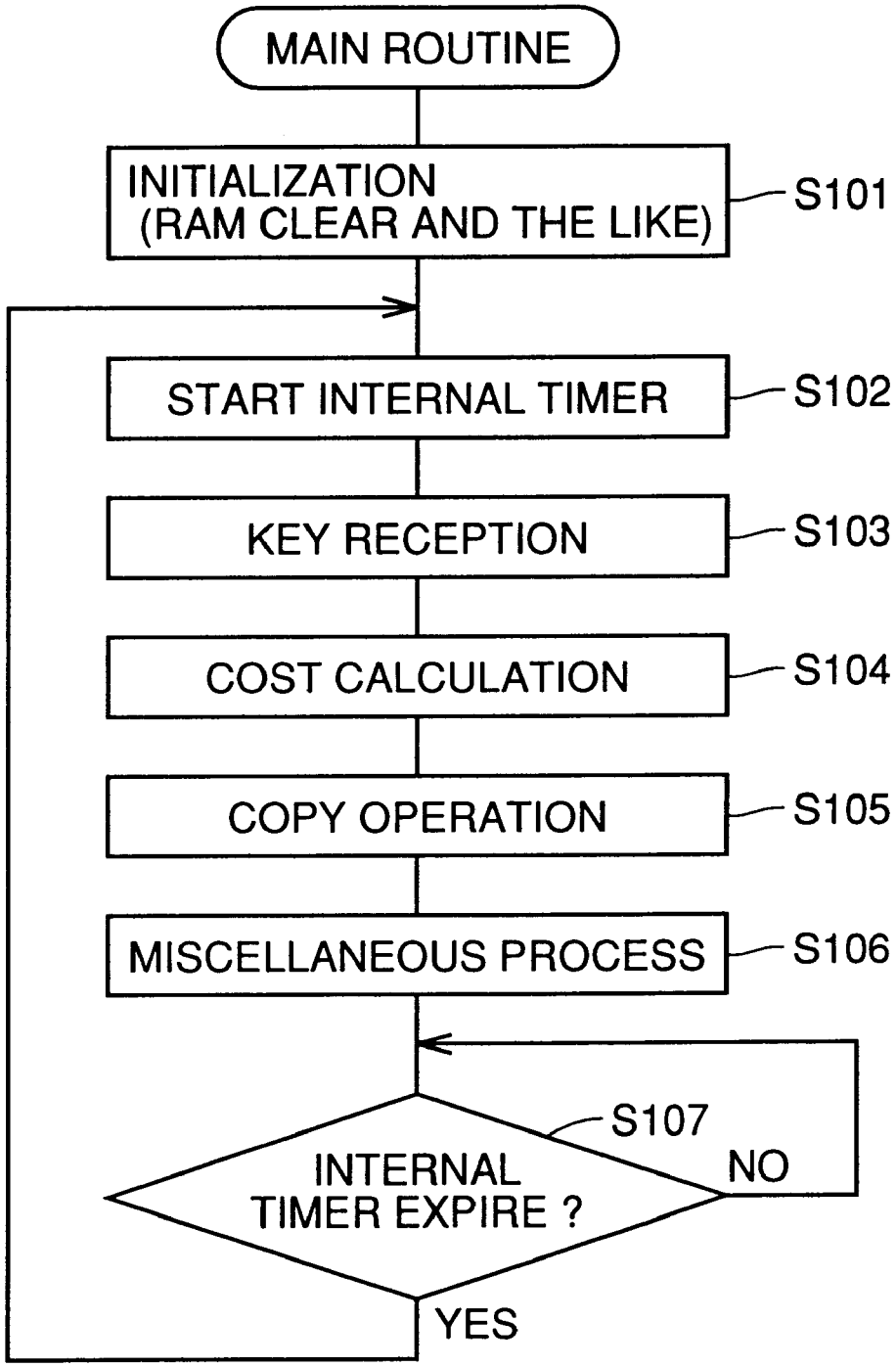
FIG. 9 is a flow chart showing the main routine of the process of the CPU of FIGS. 7A and 7B.

The cost calculation process will be described according to the flowcharts of FIGS. 9 and 10.

In response to the power being turning on, initialization such as RAM clear is effected (S101). Then, a loop process is initiated that repeatedly executes the processes of steps S103–S106 for every period of time (S107; YES) under control of an internal timer (S102).

In the key reception process (S103), entry of the key switch in operation panel 640 and the button switch on liquid crystal panel 421 is accepted. The ACS process is carried out when the ACS mode is selected by operating ACS key 644 on operation panel 640 (or by default). The full color mode or the black-and-white mode can be forcefully set via the full color key or black-and-white key 643.

The cost calculation process (S104) will be described in detail with reference to FIG. 10.

The copy operation process (S105) is directed to execute a copy operation sequence. When "cost calculation" is selected at the initial screen of FIG. 8A, the rate is displayed according to the cost calculation process, and a copy operation process is executed after confirmation is made of the indicated cost. When "start copy" is selected at the initial screen of FIG. 8A, a copy operation process is immediately executed by turning on start key 642.

The miscellaneous process (S106) is directed generically to processes not included in the above steps S103–S105, such as communication with CPU 210.

Initially, state S is 0 (refer to S110). When start key 642 is turned on (YES at step S111), control proceeds to S112 to inhibit a copy operation. Then, control proceeds to S113 to clear the memory area corresponding to the cost storage in RAM 102. The control proceeds to S114 where instruction is provided to automatic document feeder 2 to feed and set a document on glass platen 31. Then, state S is set to 1 (S115).

When state S attains 1, control proceeds to step S121 to wait for a document to be set at a predetermined position on glass platen 31. When a document is set at a predetermined position (S121; YES), the document is scanned as described before to detect the document size (S122). Also, the ACS determination process is carried out according to the scanning result (S123). When the type of the document (color small, color large, black-and-white small, black-and-white large) is determined, the counter corresponding to the relevant type is incremented (S124). Then, an instruction is provided to automatic feeder device 2 to discharge the document to discharge tray 10. Then, state S is set to 2 (S126).

When state S attains 2, control proceeds to step S131 where determination is made of the presence of a document on document tray 3 by automatic document feeder 2. When there is a subsequent document (S131; NO), an instruction is provided to automatic document feeder 2 to feed and set the next document on glass platen 31. State S is returned to 1. Then, the above process of steps S122–S125 is carried out on the next document.

When the process of steps S122–S125 is completed for all the documents in document tray 3 (S131; YES), control proceeds to step S132 to calculate the printing cost. As described above, the unit cost determined for each type of document is multiplied by the number of sheets of the relevant type (count value). The total sum thereof is obtained. The value corresponding to the number of multi-copies is to be further multiplied in the case of multi-copy. The obtained rate is displayed on liquid crystal panel 421 (S134) as shown in FIG. 8C. Then, state S is set to 3 (S135).

When state S attains 3, control proceeds to step S141 where determination is made whether the print job is to be altered or not. Here, the depression of "NO" button or "OK" button shown in FIG. 8C is expected. When the "YES" button is entered (S141; YES), the image memory is cleared since the indicated rate is not acceptable. Accordingly, a copy mode differing from the former mode can be set. In other words, the job can be altered. A process similar to that described above is carried out for the modified job, and the cost corresponding to the modified job is displayed.

When the "OK" button is depressed (S141; NO), the copy operation is initiated (S143) since the rate on the display is accepted. According to the flow chart of the present embodiment, the main scanning operation is carried out subsequent to the pre-scanning operation, so that the process corresponding to the case where image data is already stored in the image memory is shown. Therefore, the copy operation is described as to be immediately initiated according to the image data. Alternatively, a structure can be provided to set the copy mode at this current stage (at the time point of NO at step S141) and prompt resetting of a document. The main scanning operation is executed for the document set again. Then, a print out operation thereof can be initiated. Also, a structure can be provided in which the image data is stored at the main scanning operation subsequent to the pre-scanning, and set only the copy machine mode at this time point. In other words, a structure that permits a copy operation upon depression of "OK" button is provided. Furthermore, a structure can be provided to carry out a process similar to that when the "OK" button is depressed in the event that the "NO" button is not depressed at an elapse of a predetermined period of time after display of the print out cost is provided.

Second Embodiment

A second embodiment of the present invention will be described hereinafter.

Figure 11:
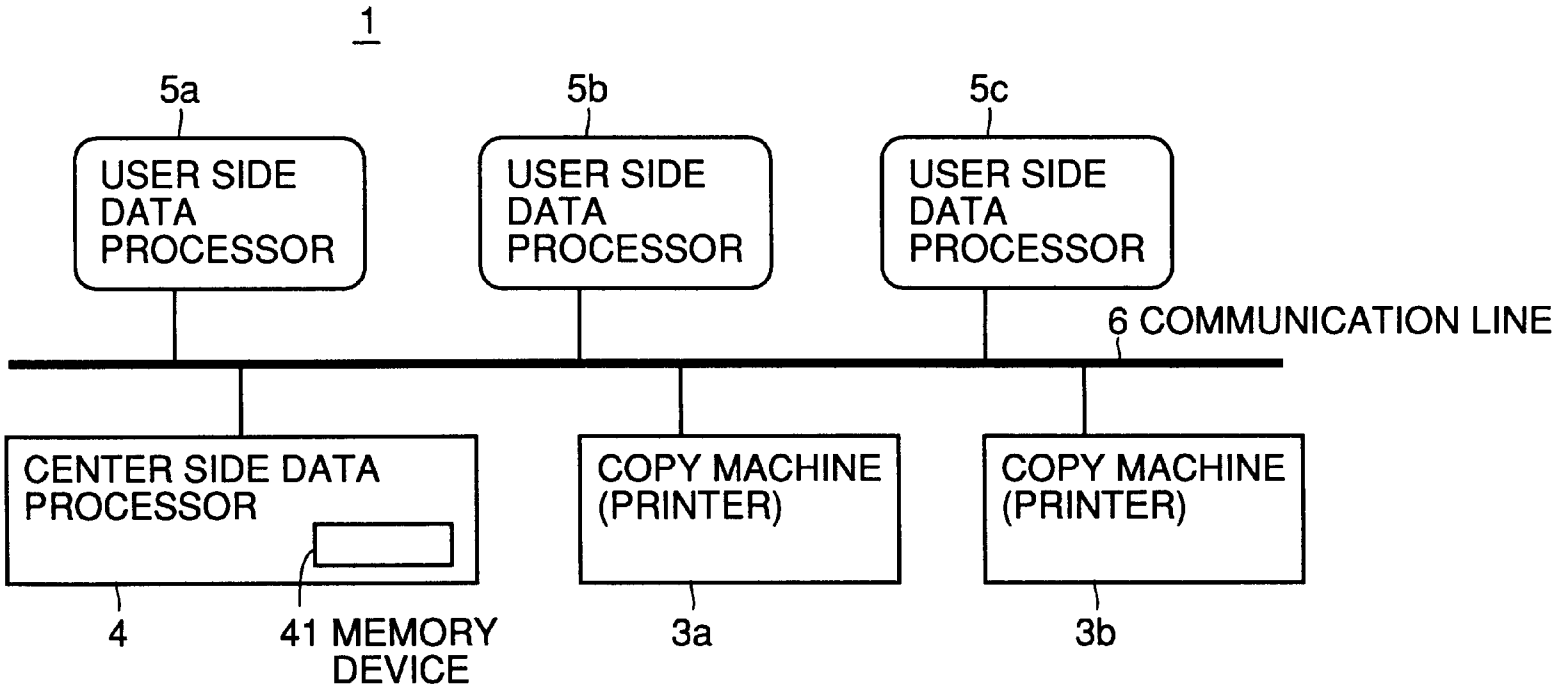
FIG. 11 shows an entire structure of a printing system according to a second embodiment of the present invention.

Referring to FIG. 11, a printing system 1 of the second embodiment has user side data processors 5*a*, 5*b*, and 5*c*, a center side data processor 4, and copy machines 3*a* and 3*b* connected by a communication line 6. The number of user side data processors 5*a*, 5*b*, 5*c* and copy machines 3*a*, 3*b* is arbitrary, and not limited to the number of the present embodiment.

User side data processors 5*a*, 5*b* and 5*c* are installed at the home of different users. Center side data processor 4 is installed at the data management center that handles in a centralized manner various types of data sent from each user. Copy machines 3*a* and 3*b* are installed at respective convenience stores located at different sites. In another embodiment, user side data processors 5*a*, 5*b*, and 5*c* are installed at different rooms in the same facility, and center side data processor 4 and copy machines 3*a* and 3*b* are installed at the same room in the same facility. It is also possible to install all or some of user side data processors 5*a*, 5*b*, 5*c*, center side data processor 4, and copy machines 3*a*, 3*b* in the same room. Communication line 6 may be, for example, a public analog line, digital line, private line, or a network such as LAN, WAN, and Internet.

Printing system 1 is directed to allow print out of the contents of an image file from any of copy machines 3*a* and 3*b* by having the user set in a readable manner the image file in which image data to be printed is stored and entering or setting the required items through any of user side data processors 5*a*, 5*b* and 5*c*.

In the second embodiment, an image file is a generic term of a file in which image data of various formats or of a compressed format is stored, a text file in which text data is stored, and the like. Copy machines 3*a* and 3*b* are digital color copy machines respectively including an image reader and a printer. The printer thereof is used to print out the image file. Details will be described afterwards.

Each of user side data processors 5*a*, 5*b*, and 5*c*, and copy machines 3*a* and 3*b* have a similar structure and function. Therefore, only one thereof will be described hereinafter. In the following, "user side data processor 5" and "copy machine 3" refer to all or some of user side data processors 5*a*, 5*b*, 5*c*, and copy machines 3*a* and 3*b*, respectively.

Figure 12:
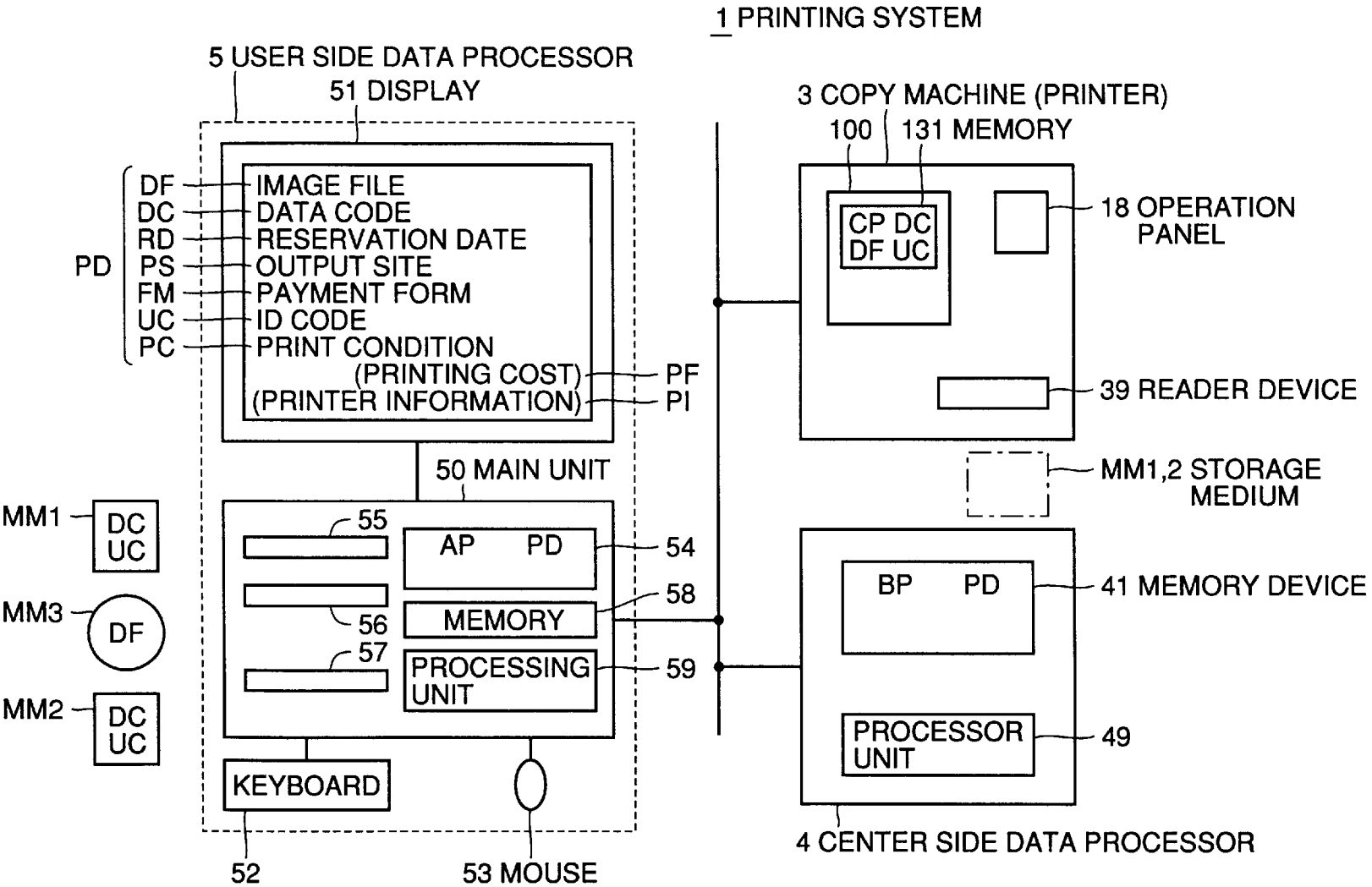
FIG. 12 is a block diagram showing in detail the function of the printing system.

FIG. 12 is a block diagram showing the structure of user side data processor 5, center side data processor 4, and copy machine 3.

Referring to FIG. 12, user side data processor 5 includes a main unit 50, a display 51, a keyboard 52, and a mouse 53. A personal computer or a workstation is employed as user side data processor 5. An appropriate program is installed therein.

Main unit 50 includes a hard disk 54, a drive device 55 for the floppy disk, a drive device 56 for a CD-ROM, a slot 57 for an IC card, a memory 58, and a processor unit 59.

Drive device 55 accesses a storage medium MM1 that is an externally set floppy disk for data reading and writing. A drive device 56 accesses a storage medium MM3 which is a CD-ROM to read in the data thereof. Slot 57 is provided for reading and writing data of a storage medium MM2 such as an IC card.

A program AP for carrying out the process in user side data processor 5 to implement printing system 1, an image file (image data) DF to be printed, image print information PD required for printing out image file DF, and other programs and data are stored in hard disk 54. These programs or data can be partially stored in memory 58. The program and data stored in hard disk 54 can be loaded appropriately to the main memory.

As shown on the screen of display 51, image print information PD includes image file DF, data code DC, reservation data RD, output site PS, payment form FM, ID code UC, print condition PC, and the like. Image file DF displayed on the screen of display 51 is the file name.

Image print information PD is entered by the user through keyboard 52 or mouse 53 according to the screen on display 51. The user enters the aforementioned items for image file DF that he/she wishes to print out. At this stage, a plurality of image files DF can be input. In other words, the printout of a plurality of image files DF can be specified by one image print information PD. Data code DC is specified by the user for each image file DF. It is to be noted that ID code UC is not entered by the user, but transmitted from center side data processor 4 in response to sending image print information PD to center side data processor 4. The details of data code DC and ID code UC will be described afterwards.

The information of image print information PD other than ID code UC is stored in hard disk 54 or memory 58 when entered through user side data processor 5. This information is transmitted to center side data processor 4 through communication line 6. In the present specification, "image print information PD" refers to the entire image print information PD, or some of the information thereof, particularly information excluding ID code UC.

According to the currently available electronic system such as electronic money or electronic banking, the payment of the cost for printing out image file TF can be settled through user side data processor 5.

In processor unit 59, program AP stored in hard disk 54 is executed to carry out various processes that will be described afterwards.

Center side data processor 4 is a personal computer or a workstation, for example, similar to user side data processor 5. A program BP for implementing printing system 1 through the processes of center side data processor 4, image print information PD sent from user side data processor 5, ID code UC generated at center side data processor 4, and the like are stored in memory device 41 such as a hard disk or memory provided in the main unit of center side data processor 4.

In processor unit 49, program BP is executed to carry out various processes such as sending image print information PD to copy machine 3, comparing data code DC and ID code UC sent from copy machine 3 with relevant codes stored in memory device 41, and the like.

Copy machine 3, which is a digital color copy machine includes both the function as a copier for reading out the image on a document and reproducing an image thereof, and a printer device for receiving an image file (image data) output from an external apparatus such as center side data processor 4 to reproduce an image corresponding to the contents of the image file. Copy machine 3 includes an interface and a communication control device for connection with communication line 6.

Copy machine 3 includes an operation panel 18, a control unit 100, and a storage medium reader device 39. Control unit 100 is provided with a memory 131 such as a hard disk or a semiconductor memory. A program CP for providing control of the printer, data code DC and ID code UC entered through operation panel 18 or read out from storage medium MM1, 2 by a storage medium reader device 39, image file DF sent from center side data processor 4, and some of image print information PD are stored in memory 131.

By setting storage medium MM1, 2, storage medium reader device 39 reads out data code DC and ID code UC stored therein for input. The details will be described afterwards.

Figure 13:
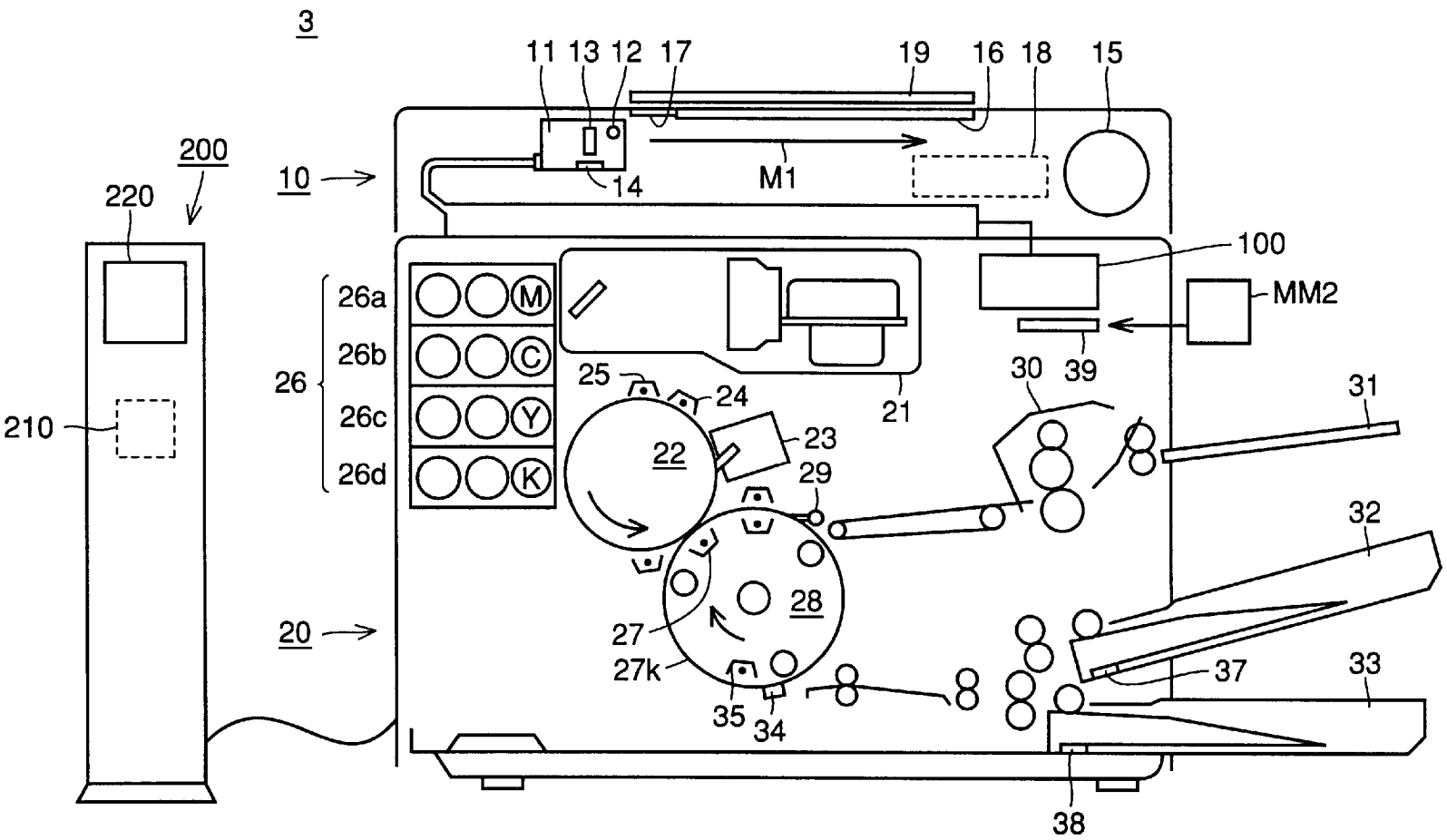
FIG. 13 shows the entire structure of a copy machine according to the present invention.

Referring to FIG. 13, a copy machine 3 includes an image reader 10 for reading out the image of a document, a printer 20 for receiving the image read out by image reader 10 or image signals of an image file output from an external apparatus for reproducing an image corresponding to the image file, and a vendor apparatus 200 used for payment of the printing cost.

Image reader 10 includes a scanner 11, a document glass panel 16, a document cover 19, an operation panel 18 and the like. Operation panel 18 is provided at the front face or top face of image reader 10.

Scanner 11 includes an exposure lamp 12 for irradiating a document, a rod lens array 13 for collecting light reflected from the document, and a contact type CCD color image sensor for converting the light collected by rod lens array 13 into electrical signals (referred to as "CCD sensor" hereinafter) 14.

Figure 14:
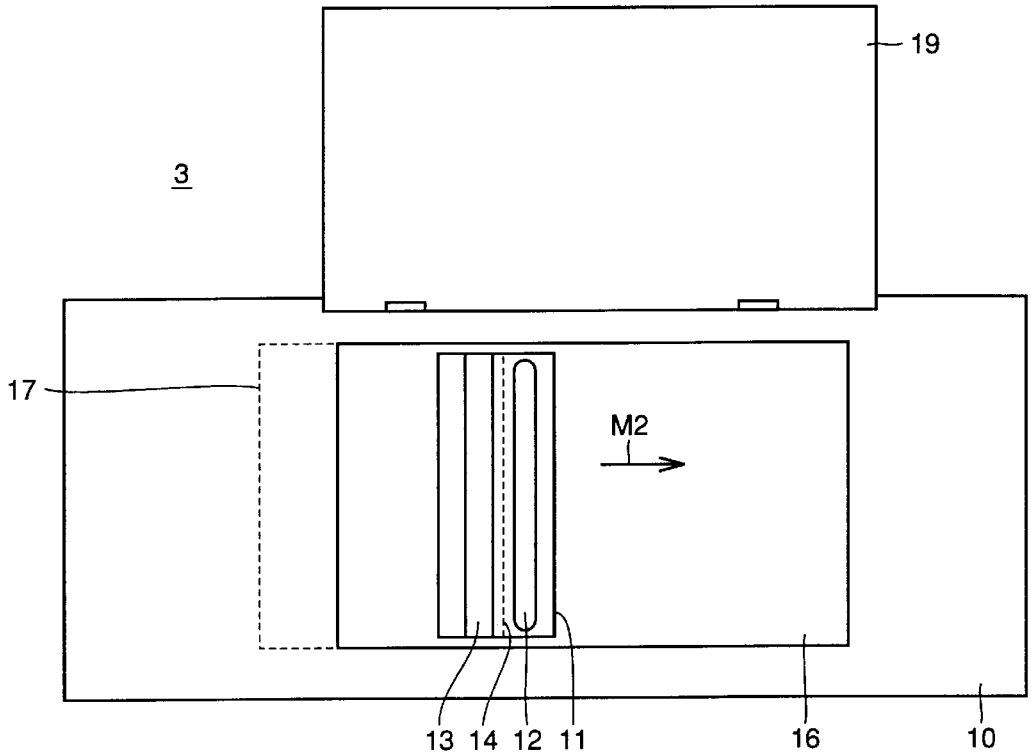
FIG. 14 is a top view of an image reader of a copy machine.

FIG. 14 is a top view of image reader 10 with document cover 19 open. Document cover 19 can attain an open/closed state with one side as an axis. By closing document cover 19, the document mounted on document glass panel 16 is secured during scanning. Also, document cover 19 prevents the light of exposure lamp 12 from spreading outwards.

Exposure lamp 12 and CCD sensor 14 parallel to each other and having a length substantially equal to the width of document glass panel 16 are provided in a direction orthogonal to the direction of arrow M2 (the subscanning direction) in FIG. 14. A white reference plate 17 used for shading correction is provided at the left side of document glass panel 16.

Referring to FIG. 13 again, scanner 11 is driven by motor 15 to move in the direction of arrow M1 in the reading operation of a document. A total of four scans are carried out corresponding to each color of yellow Y, magenta M, cyan C and black K for one document mounted on document glass panel 16. CCD sensor 14 is provided with filters (not shown) of red R, green G and blue B to carry out reading of three colors at the same time in one scan.

The image on the face of the document irradiated with exposure lamp 12 of scanner 11 is photoelectrically converted by CCD sensor 14 to be provided to control unit 100 as multi-value electric signals of red R, green G and blue B. When copy machine 3 is used as a printer, the signals of image file DF sent from an external apparatus is received by control unit 100 as multi-value electric signals of red, green, and blue.

The multi-value electric signals in control unit 100 are converted into concentration data of yellow Y, magenta M, cyan C and black K by image signal processor 120 (refer to FIG. 17) to obtain an optimum reproduced image.

Each density data is subjected to a correction (γ correction) according to the tone characteristic of the photoconductor and a dither process in printer control unit 130 (refer to FIG. 17) of control unit 100 to be provided as an output control signal to a print head unit 21 incorporating a laser diode. Print head unit 21 emits a laser beam of an intensity corresponding to each concentration data according to the output control signal.

The surface of photoconductor drum 22 is exposed for each color of reproduction.

Prior to this exposure, the surface of photoconductor drum 22 has residue toner removed by a cleaner 23 and is further exposed by an eraser lamp 24 to be discharged. Then, the surface of photoconductor drum 22 is charged uniformly by a corona charger 25. When the surface of photoconductor drum 22 is exposed at a uniformly charged state, an electrostatic latent image is formed on the surface of photoconductor drum 22.

Toner developing unit 26 includes toner developing devices 26*a*–26*d* of each color of magenta M, cyan C, yellow Y and black K. Toner developing unit 26 is driven vertically by an elevating device not shown in synchronization with the rotation of photoconductor drum 22. One of toner developing devices 26*a*–26*d* corresponding to the color component of the electrostatic latent image is selected to develop the image on the surface of photoconductor drum 22.

Sheet size detection sensors 37 and 38 formed of a photoelectric sensor and the like are provided at sheet cassettes 32 and 33, respectively. A print out sheet of a size specified by the user or from printer control unit 130 is fed out from sheet cassettes 32 and 33 according to the detection signal from sheet size detection sensors 37 and 38. The sheet supplied from sheet cassettes 32 and 33 has its leading edge clamped by a chucking mechanism 34 on transfer drum 28 and electrostatically adsorbed by an adsorption charger 35 to be wound around transfer drum 28 in a state that eliminates position offset. The developed image on the surface of photoconductor drum 22 is transferred onto the sheet wound around transfer drum 28 by a transfer charger 27.

This printing stroke is repeatedly carried out for each color of magenta M, cyan C, yellow Y and black K. When the printing is completed for all the colors, a disengage claw 29 is actuated, whereby the sheet is detached from the surface of transfer drum 28.

The toner image transferred onto the sheet is unstable and will be easily peeled off when touched. Therefore, the sheet is pressed while being heated in fixation apparatus 30 to fix the toner between the fiber of the sheet. Then, the sheet is discharged on discharge tray 31.

Figure 15:
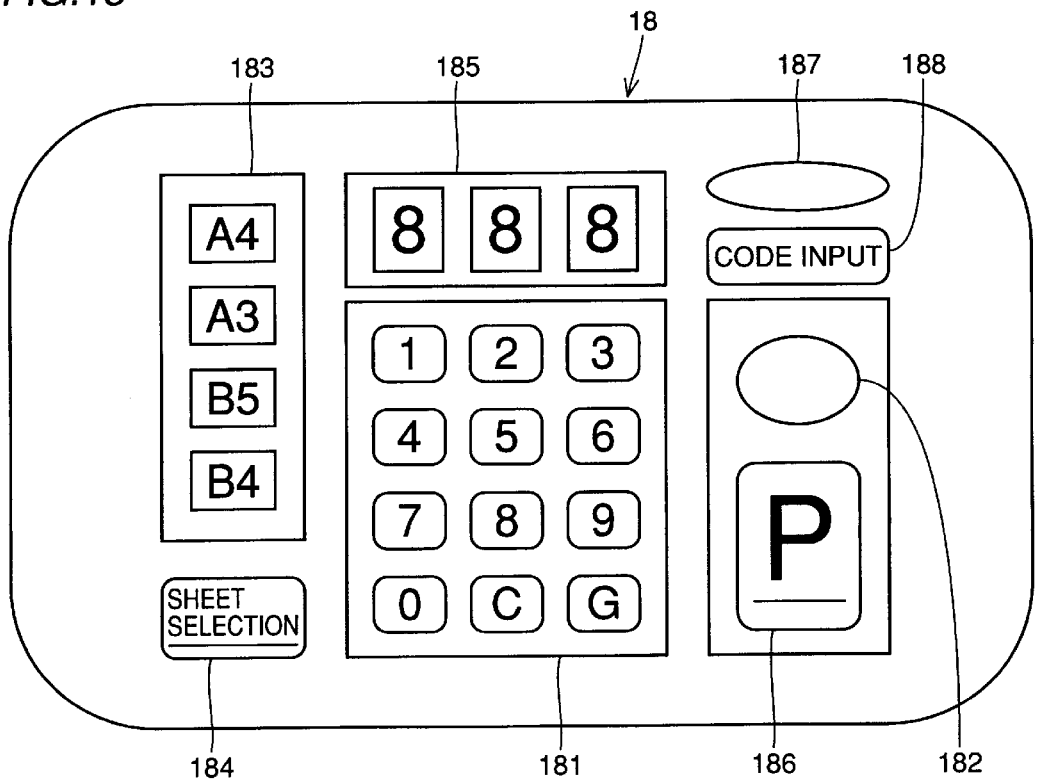
FIG. 15 shows an operation panel of a copy machine.
Figure 16:
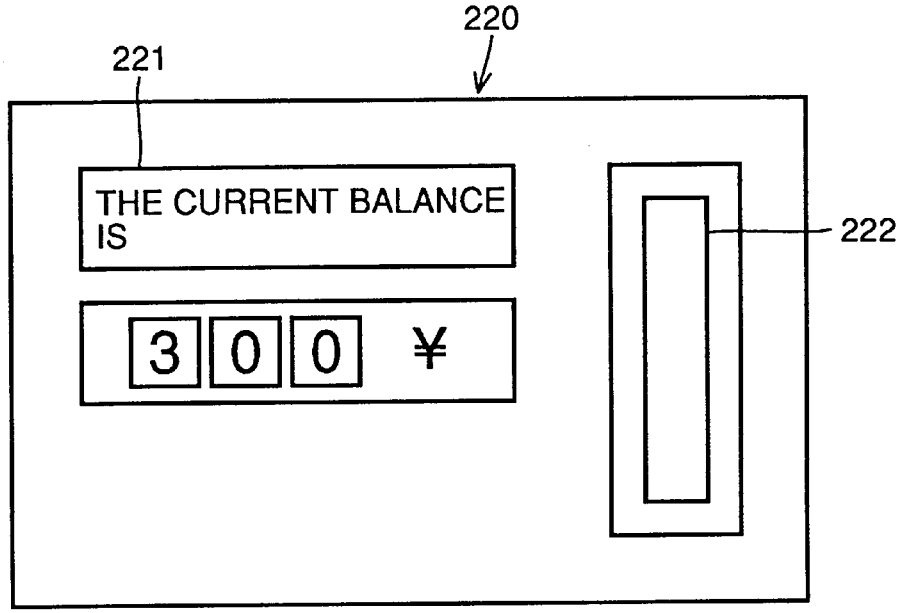
FIG. 16 shows a vendor panel of a copy machine.

Referring to FIG. 15, operation panel 18 includes a ten key 181, a display 182 indicating permission of printing, a display 183 indicating the sheet size, a sheet select key 184 for selecting the sheet size, a display 185 indicating the number of copies or prints, a start key 186 for designating initiation of a copy or printing operation, a display 187 indicating the input mode for the data code and the ID code, and a code input key 188.

Ten key 181 is used to enter the number of copies when copy machine 3 functions as a copy apparatus, and to input the data code and the ID code corresponding to the user's code when functioning as a printer. Code input key 188 is used to set or cancel the mode for entering the data code and the IC code.

When the light of display 187 is turned off, copy machine 3 can be used as a copier. When the light of display 187 is turned on, copy machine 3 can be used as a printer. The code entered via ten key 181 is stored in memory 131 as the data code. The light of display 187 attains a blinking state when the data code is entered. The code entered through ten key 181 is stored in memory 131 as the ID code.

Referring to FIG. 13 again, vendor apparatus 200 includes a vendor control unit 210 and a vendor panel 120. Vendor control unit 210 provides control of the operation of vendor apparatus 200, and is connected to control unit 100 of copy machine 3. Vendor panel 220 includes a coin inlet 222 through which a user inserts a coin for the payment of a printing cost, and a display 221 providing the balance of the inserted coins.

Figure 17:
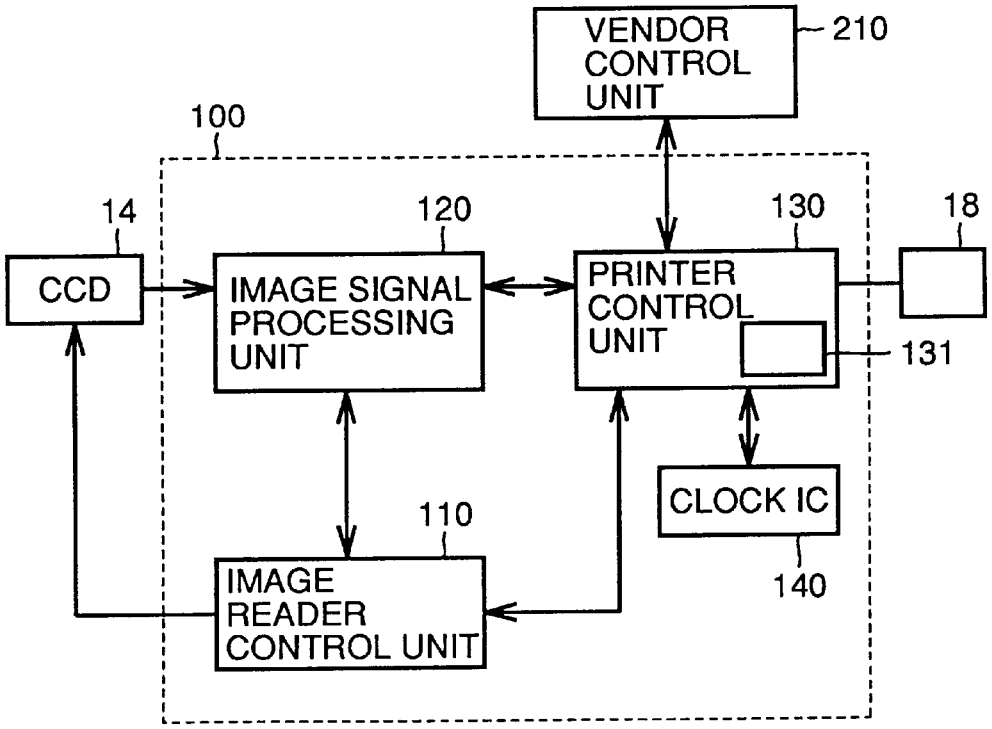
FIG. 17 is a block diagram showing a structure of a control unit of a copy machine.

Control unit 100 will be described hereinafter with reference to FIG. 17.

Control unit 100 includes an image reader control unit 110, an image signal processing unit 120, a printer control unit 130, and a clock IC 140.

Image reader control unit 110 provides the control of each operation of image reader unit 10 in reading out a document. More specifically, CCD sensor 14 is driven and the ON/OFF of exposure lamp 12 is controlled. Motor 15 is driven to control the scanning operation of scanner 11.

Image signal processing unit 120 processes the image signals of red R, green G and blue B from CCD sensor 14 of scanner 11 to convert the same into image data of the colors of magenta M, cyan C, yellow Y and black K to obtain the optimum reproduced image.

Printer control unit 130 is directed to control the operation of each component in printer unit 20. The image data output from image signal processing unit 120 is subjected to y correction, and then to a dither process when a multi-value dither method is employed as a tone reproduction method. The output of print head unit 21 is controlled. Also, overall control is provided under synchronization of various operations such as sheet supply from sheet cassettes 32 and 33, rotation of photoconductor drum 22 and transfer drum 28, elevation of toner developing unit 26, and charge supply to each charger.

Image print information PD will be described in detail with reference to FIGS. 18 and 19.

As shown in FIG. 18, image print information PD1 includes data code DC, date of reception JT, date of transmission ST, reservation date RD, payment form FM, image file DF, presence/absence of reservation RI, time before erasure ET, ID code UC, and print condition PC.

Data code DC serves to identify respective image files DF of each user. In general, the user assigns a comprehensible unique code as data code DC for each image file DF. As to the image files DF handled by the user himself/herself, the data code DC differs for each different image file DF. However, in the relationship with data code DC of another user, there is a possibility that the same data code DC may be assigned independent of the same or different image file DF. Although alphanumerics are used for data code DC, kanji, katakana, and hiragana characters can also be used. In the present embodiment, only numerics that can be entered through ten key 181 is used. It is to be noted that a data code DC may be identical to the file name of an image file DF. It is therefore possible to use a file name instead of a data code DC. The data code is sometimes called the "user code".

Data code DC is data that may be known to other users. When a list of data codes DC is provided on the display in copy machine 3, each user can easily select his/her own data code DC that is to be printed from the displayed list. In such a case, ID code UC that will be described next must be entered in addition to data code DC to actually print out an image.

ID code UC is a code assigned to each user, and must not be known to other users. In the present embodiment, each image print information PD transmitted to center side data processor 4 is assumed to correspond to one user. One ID code UC is assigned for every one transmitted image print information PD. It is also possible to assume that one image file DF corresponds to one user.

More specifically, when image print information PD is sent from user side data processor 5 to center side data processor 4, one ID code UC is automatically generated for the sent image print information PD at center side data processor 4. The generated ID code UC is stored at center side data processor 4 as a part of image print information PD, and sent to user side data processor 5.

One image print information PD includes one or a plurality of data codes DC, i.e. one or a plurality of image files DF that is to be printed out. Even in the case where there are a plurality of data codes DC (image files DF), one ID code UC corresponds to one image print information PD.

The user enters the ID code UC corresponding to the designated image print information PD at copy machine 3, whereby printout of image file DF specified by image print information PD can be carried out by copy machine 3. In other words, ID code UC includes the security feature to prevent a specified image file DF from being printed out by another user.

Alphanumerics, kanji, katakana, and hiragana characters can be used as ID code UC. In the present embodiment, only numerics are used so that an ID code UC can be entered through ten key 181.

Referring to FIG. 19, when three image files DF of "A", "B" and "C" are specified by one image print information PD, one ID code UC "1234" is generated. The generated ID code UC is assigned to the relevant user. Here, the same ID code UC "1234" corresponds to any of data codes DC of "111", "222" and "333".

The user has to be aware of his/her own input data code DC and corresponding ID code UC. Note can be taken of these codes displayed on the screen of display 51, or recorded in storage medium MM1, 2 as in the present embodiment. The recorded storage medium MM1, 2 can be set in storage medium reader device 39 of copy machine 3, so that data code DC and ID code UC can be directly entered from storage medium MM1, 2 to copy machine 1.

Therefore, the trouble for the user remembering or noting down data code DC and ID code UC is eliminated. Also, the user does not have to use operation panel 18 to enter the codes in copy machine 3. This prevents the entry of a wrong code due to remembering a wrong number or by erroneous input. The proper data code DC and ID code UC can always be entered.

Print condition PC is the condition of various printing forms required for the printout in reproducing image file DF by copy machine 3.

FIG. 20 shows various items of print condition PC. Print condition PC includes the number of prints, the output color (monocolor/color), duplex output (two-side/one-side), staple (designated/not designated), punch (designated/not designated), the sheet size, picture quality, and the like.

Each of the items is set by the user to a desired value or form at user side data processor 5 to be stored as patterns "a"–"f". This print condition PC pattern is assigned by the user for image file DF to be printed out. For example, image file A is printed out under the print condition pattern of "a", and image file F is printed out under the print condition of pattern of "f".

When print condition PC is set and assigned for image file DF, printing cost PF of image file DF under print condition PC is calculated by center side data processor 4 or copy machine 3 to be provided to user side data processor 5 on display 51.

Since print condition PC can be set at user side data processor 5, it is not necessary to set print condition PC manually at copy machine 3. Therefore, the trouble of manipulation or time required by erroneous operation for a user unfamiliar with the manipulation of copy machine 3 can be reduced.

Since the user can identify printing cost PF in advance before print out is executed by copy machine 3, print condition PC can be altered when the expense for print out is too high. Furthermore, the problem of insufficient amount for payment can be prevented in the event of paying printing cost PF at the installed site of copy machine 3.

Referring to FIG. 18 again, date of reception JT is the date of receiving image print information PD at center side data processor 4. The year, month, day, and time are automatically recorded by an internal clock in center side data processor 4. Date of transmission ST is the date of transmission of image file DF to copy machine 3. Reservation date RD is the year, month, day and time for printing to be carried out at the designated date. When only the year, month, and day are specified for the reservation date RD without the specific time, determination is made that printing during the nighttime is specified.

Payment form FM is to designate the form of payment of printing cost PF. Specific payment such as "prepayment", "post payment" and "remittance" are recorded. "Prepayment" or "remittance" indicates that the cost required for printing is already paid in transmitting image print information PD from user side data processor 5 to center side data processor 4. Various methods of payment by data communication called electronic money, electronic banking, electronic settlement, or deposit from a predetermined bank account can be employed. In the case of "prepayment", the charge corresponding to the relevant printout is deposited from a prepaid amount at the time point an ID code UC is assigned in response to transmission of image print information PD to center side data processor 4. "Remittance" corresponds to the case where a remittance of the amount for the print out of an image file DF is made.

By this prepayment or settlement, there is an advantage that the period of time of retaining image print information PD at center side data processor 4 is expanded. It is therefore desirable for the user to settle the cost by prepayment or transaction to avoid the trouble of resending image print information PD in the case where execution of printout by copy machine 3 might be deferred. "Post payment" corresponds to the case where the payment is settled by inserting a coin into coin inlet 222 in real-time execution of printout by copy machine 3.

Image file DF contains image data that is generally of an amount significantly greater than other data. Therefore, only the file name may be recorded and the actual data stored separately. When image file DF is erased, "erased" is recorded. Reservation RI is recorded according to the setting of reservation date RD by "designated" or "not designated". Time until erasure ET indicates the time (minutes) before image print information PD stored in storage device 41 is to be erased.

The process carried out by print system 1 will be described with reference to FIGS. 21–24.

Figure 21:
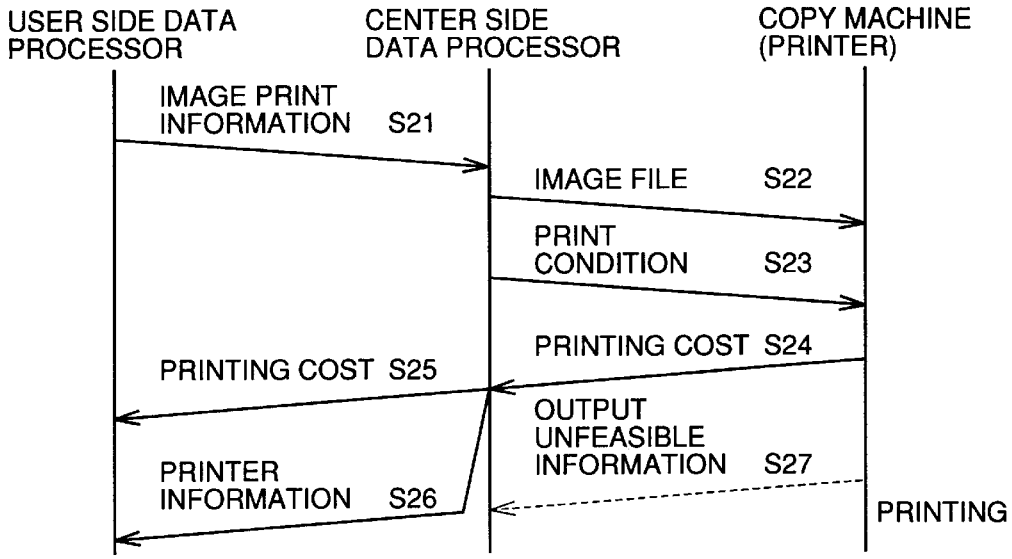
FIGS. 21 and 22 show the process sequences of first and second specific examples in the second embodiment.

FIG. 21 shows the sequence of a first specific example of print system 1 of the second embodiment, related to calculation and display of printing cost PF. Referring to FIG. 21, the user operates user side data processor 5 to transmit image file DF to be printed out and image print information PD including print condition PC to center side data processor 4 (S21). Thus, a printing request is sent to center side data processor 4.

Upon receiving image print information PD, center side data processor 4 sends image file DF and print condition PC to copy machine 3 (S22, S23).

Printing cost PF corresponding to the printout of image file DF according to print condition PC at copy machine 3 is calculated. The calculated printing cost PF is sent from copy machine 3 to center side data processor 4 (S24). Printing cost PF is further transmitted from center side data processor 4 to user side data processor 5 to be provided on display 51 (S25).

If the user is satisfied with the printing cost PF indicated on display 51, the user goes to the installed site of copy machine 3 to obtain the print out of image file DF. Specific processes up to obtaining the print out of image file DF will be described afterwards according to the sequence diagram of FIG. 24.

When a print out according to print condition PC specified by the user cannot be achieved out due to copy machine 3 lacking the relevant function, printing cost PF is not calculated, and output unfeasible information NP is sent from copy machine 3 to center side data processor 4 (S27).

Printer information PI is sent from center side data processor 4 to user side data processor 5 to be provided on display 51 (S26). Print information PI provides information of details of the ability of copy machine 3 and printing cost PF in carrying out printing with respect to copy machine 3 that can print out image file DF according to print condition PC.

Referring to FIG. 23, printer information PI includes the unit cost, machine name, installed site of copy machine 3 in addition to the range and form that can be set for each item of print condition PC shown in FIG. 10.

The user selects a copy machine 3 that satisfies the desired print condition PC from print information PI to obtain a printed output under the desired print condition PC.

Figure 22:
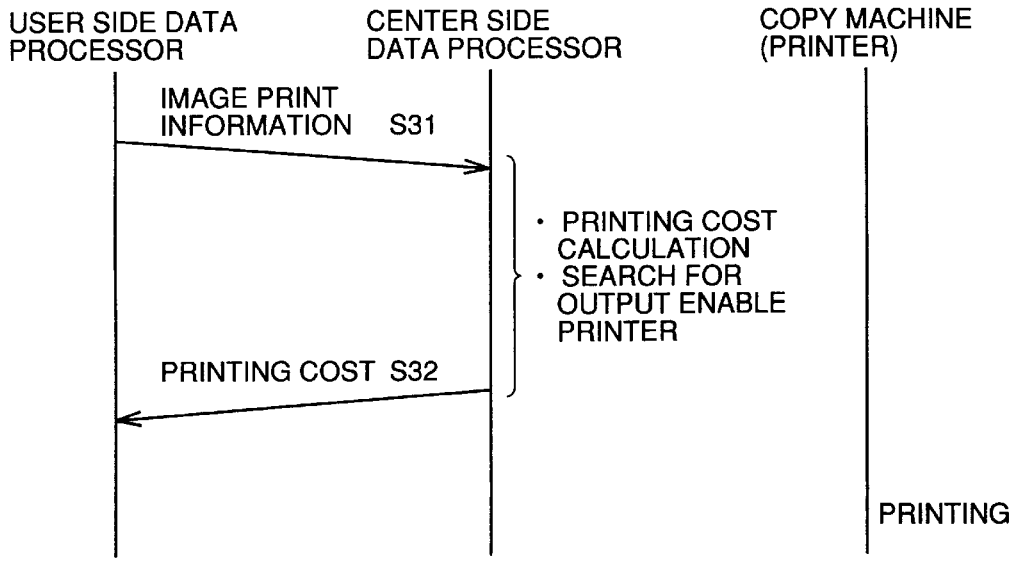

FIG. 22 shows a second specific example of printing system 1 of the second embodiment.

Similar to the first specific example, the user operates user side data processor 5 to transmit image file DF to be printed and image print information PD including print condition PC to center side data processor 4 (S31).

At center side data processor 4, printing cost PF corresponding to execution of printing image file TF according to print condition PC is calculated. The calculated printing cost PF is sent from center side data processor 4 to user side data processor 5 to be provided on display 51 (S32).

A structure can be provided in which a copy machine 3 that can print out according to print condition PC requested by the user out from the plurality of copy machines 3 connected to center side data processor 4 can be searched for by a process at center side data processor 4, and have the printing cost PF for the identified copy machine 3 provided on display 51. In this case, the user can select a copy machine 3 corresponding to the lowest charge.

The specific process of obtaining a printed output of image file DF by copy machine 3 will be described hereinafter with reference to FIG. 24.

Figure 24:
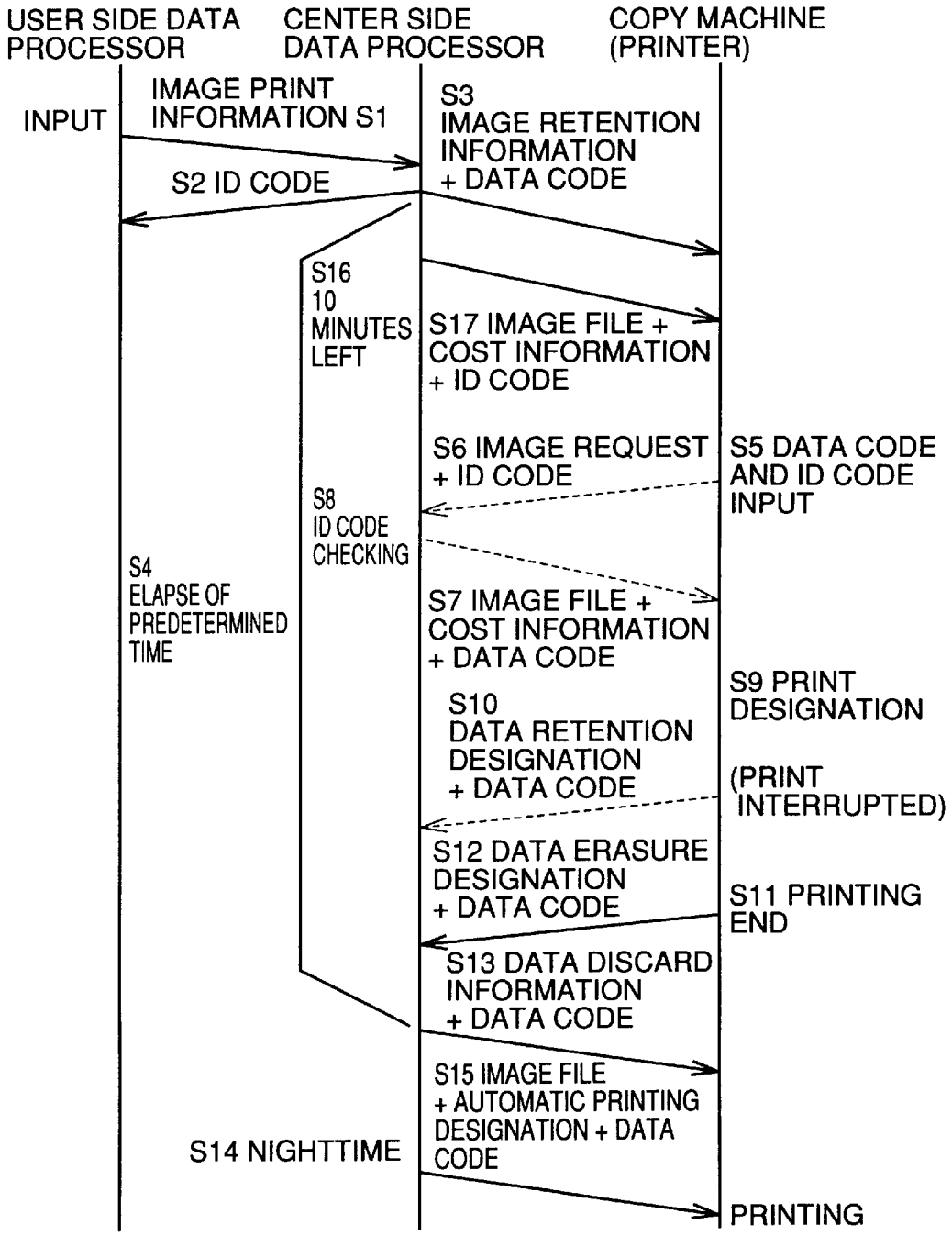
FIG. 24 shows the sequence of the entire process and operation of the printing system.

The sequence of FIG. 24 is the process omitted from the sequences of FIGS. 21 and 22, particularly directed to the process or manipulation of executing printing. The sequence of FIG. 24 is applicable to both the first and second specific examples of FIGS. 21 and 22.

The user operates user side data processor 5 to transmit image print information PD of interest to center side data processor 4 (SI). Accordingly, a printout is requested to center side data processor 4. At this stage, the fee of printing can be remitted or settled with respect to center side data processor 4 electronically.

Upon receiving image print information PD, center side data processor 4 generates a different ID code UC for every user, i.e., for every image print information PD. The generated ID code UC is transmitted to the corresponding user side data processor 5 (S2). At user side data processor 5, the received ID code UC is displayed on the screen of display 51. The user records the received ID code UC into recording medium MM1, 2. The user must remember or note down ID code UC provided on the display screen when recording medium MM1, 2 is absent.

In addition to transmission of ID code UC, center side data processor 4 sends information indicating retention of image file DF (image retention information) together with data code DC to copy machine 3 of interest. At this stage, information of the reservation date RD and payment form FM is sent (S3). The transmitted information is stored in memory 131 of copy machine 3.

At the same time, the measurement of time is initiated to obtain the timing of erasing the set of the received image print information PD (S4). At the elapse of a certain time, image file DF corresponding to ID code UC is erased. Information indicating that data code DC and image file DF are discarded is sent to copy machine 3 of interest (S13).

Upon transmitting image print information PD from user side data processor 5, the user takes storage medium MM1, 2 in which the received corresponding ID code UC is recorded and goes to a certain site, for example, to a convenience store where the designated copy machine 3 is installed.

The user operates operation panel 18 of that copy machine 3, and sets storage medium MM1, 2 in storage medium reader device 39 to enter data code DC and ID code UC which is the user code (S5). In the case of absence of storage medium MM1, 2, data code DC and ID code UC are entered manually via operation panel 18.

Following entry of the user code, a check is made whether the input data code DC is present in the DC codes DC stored in memory 131. When there is a match, information requesting image file DF (image request) is sent together with ID code UC to center side data processor 4.

Upon receiving the image request, center side data processor 4 compares the received ID code UC with ID code UC stored in memory device 41 to determine whether there is a match or not (S8). When the received ID code UC and corresponding data code DC match, the corresponding image file DF, information of whether payment of the copy fee is settled or not, and data code DC are transmitted to copy machine 3 (S7).

In other words, printing is allowed only when the ID code UC previously transmitted to user side data processor 5 matches ID code UC entered by the user through copy machine 3. Printing cannot be effected when the code does not match. This prevents erroneous printout of image file DF and an unqualified printout of image file DF by another person.

Upon depression of start key 186 on operation panel 18, copy machine 3 initiates the printing out operation of the specified image file DF (S9). The user must settle the payment by transferring an amount into a predetermined bank account or by inserting a coin into coin inlet 222 of vendor device 200.

When the printing operation is completed normally at copy machine 3 (S11), data erasure designation information is sent together with data code DC from copy machine 3 to center side data processor 4 (S12). Upon receiving data erasure designation information, center side data processor 4 erases image print information PD corresponding to that data code DC from memory device 41. Therefore, the usability of memory device 41 is improved.

When the printing operation is interrupted at copy machine 3 due to some cause such as shortage of a recording sheet, data retention designation information is transmitted from copy machine 3 to center side data processor 4 (S10). Upon receiving data retention designation information, center side data processor 4 temporarily suppresses the time count of erasing the corresponding image print information PD, or prolongs the count time.

When the time elapses, image print information PD stored in memory device 41 of center side data processor 4 is forcefully erased even when printing of image file DF has not been carried out by copy machine 3.

There is a case of requesting print out during night when copy machine 3 is not frequently used and when the electric charges is low. Nighttime is often specified for reservation date RD. When there is no specification of the time for reservation date RD, automatic printing at the time of entering the nighttime period is designated (S14).

In the case of automatic print designation, automatic print designation information is sent together with data code DC and image file DF from center side data processor 4 to copy machine 3 (S15). Upon receiving automatic print designation information, copy machine 3 executes printing of the corresponding image file DF. Information such as data code DC can be automatically added to the print out. In this case, the printed out sheet can be sequentially delivered to the relevant user for exchange of the expense. When the cost is already paid, the user can obtain the printout by indicating data code DC and ID code UC.

The process operation of printing system 1 of the first and second embodiments will be described hereinafter with reference to flowcharts.

Figure 25:
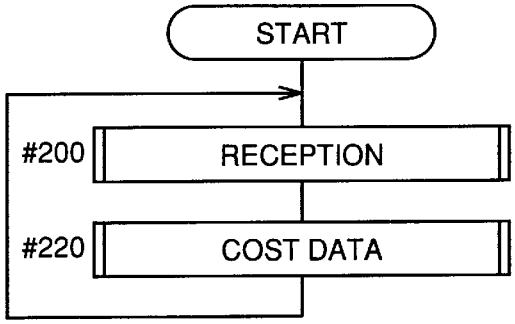
FIG. 25 is a flow chart showing the overall process of the center side data processor.

FIG. 25 is a flow chart showing the overall process of center side data processor 4. Center side data processor 4 receives data from user side data processor 5 and copy machine 3 (#200). Then, the cost data process (#220) for calculating the cost required for printing image file DF according to print condition PC (#220) is carried out. These processes are executed by program BP stored in memory device 41 of center side data processor 4.

Figure 26:
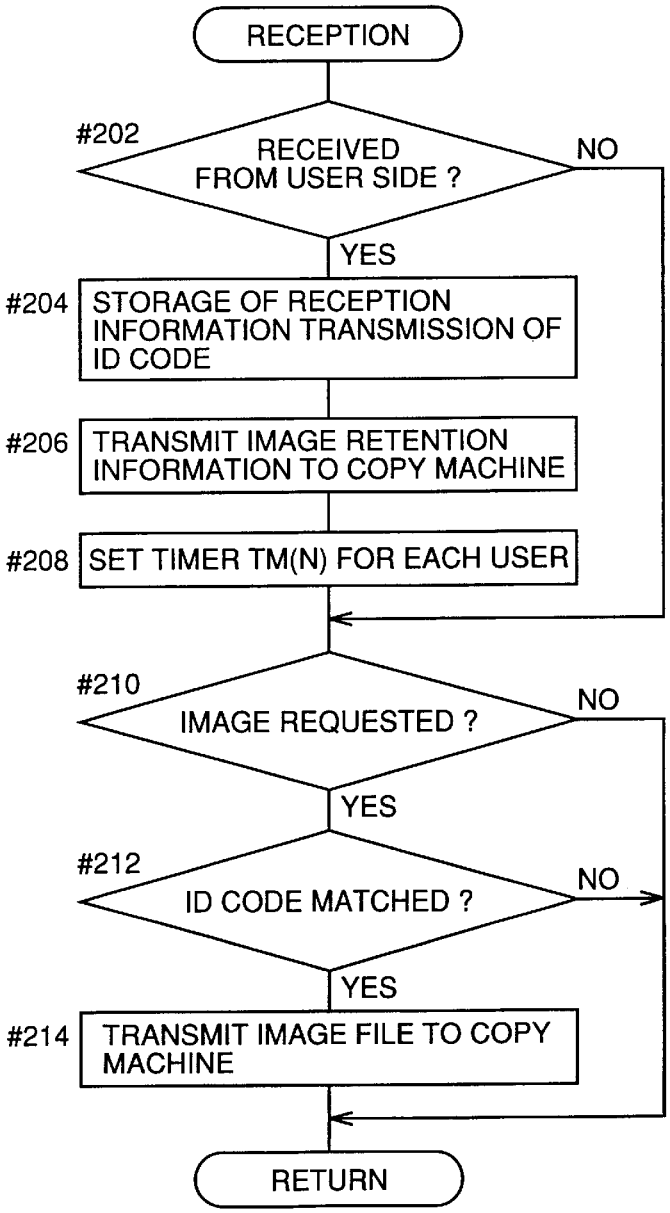
FIG. 26 is a flow chart showing the contents of a reception process.

FIG. 26 is a flow chart showing the contents of the reception process.

When image print information PD is received from user side data processor 5 (#202; YES), control proceeds to #204 to store the received image print information PD together with the date of reception JT. Also, ID code UC is generated and sent to user side data processor 5 (#204). Then, image retention information indicating retention of image file DP is sent to copy machine 3 together with data code DC (#206). Accordingly, the received data code DC is stored in memory 131 at copy machine 3. At the same time, a timer TM (N) for obtaining the timing to erase the stored image print information PD is set for each user to initiate time counting (#208).

When image file DF is requested from copy machine 3 (#210; YES), a check is made whether an ID code UC identical to ID code UC that is requested is stored in memory device 41 (#212). If there is a match, the corresponding image file DF, cost payment information, and data code DC are sent to copy machine 3 (#214).

Figure 27:
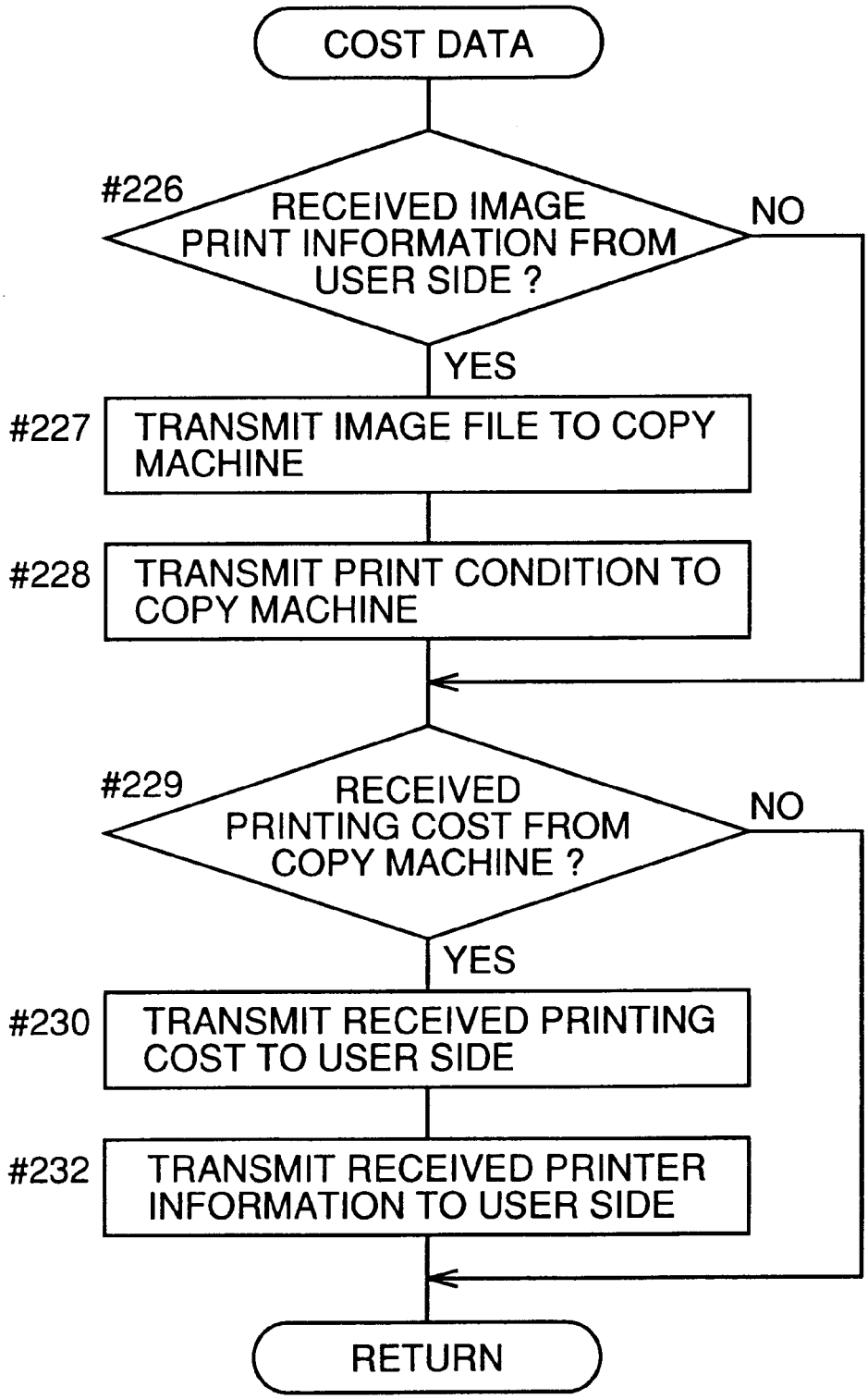
FIG. 27 is a flow chart showing the contents of a cost data process of a first specific example.

FIG. 27 is a flow chart showing the cost data process of a first specific example.

When image file DF from user side data processor 5 and image print information PD including print condition PC are received (#226; YES), the received image file DF is transmitted to copy machine 3 (#227). Then, print condition PC is sent to copy machine 3 (#228). Upon receiving printing cost PF calculated at copy machine 3 (#229; YES), printing cost PF is transmitted to user side data processor 5 (#230). Printer information PI from copy machine 3 is sent to user side data processor 5 (#232).

Figure 28:
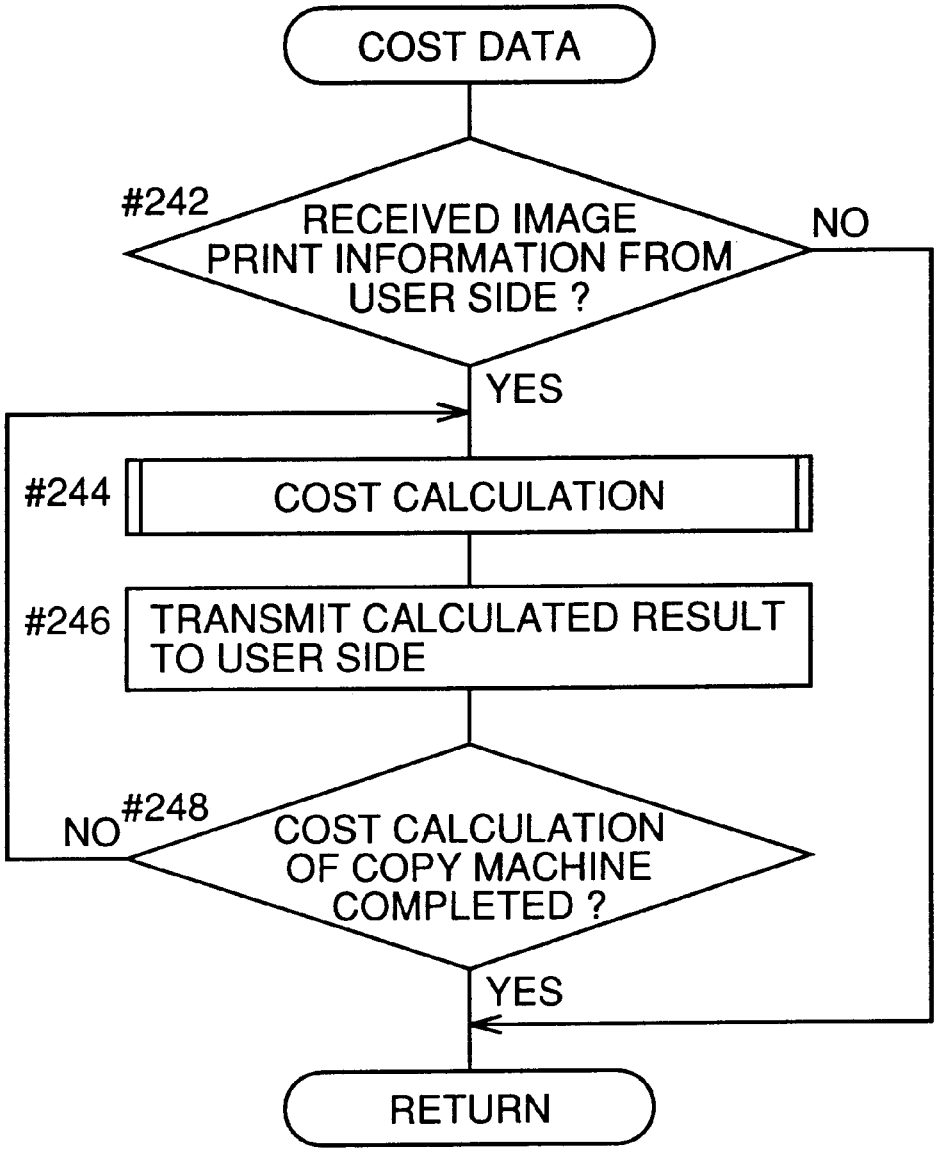
FIG. 28 is a flow chart showing the contents of a cost data process according to a second specific example.

FIG. 28 is a flow chart showing the cost data process of a second specific example.

When image file DF from user side data processor 5 and image print information PD including print condition PC are received (#242; YES), the cost calculation process is carried out (#244). The calculated result is sent to user side data processor 5 (#246). When the cost calculation process for all the copy machines that allow printout according to print condition PC is completed (#248; YES), the main routine ends.

Figure 29:
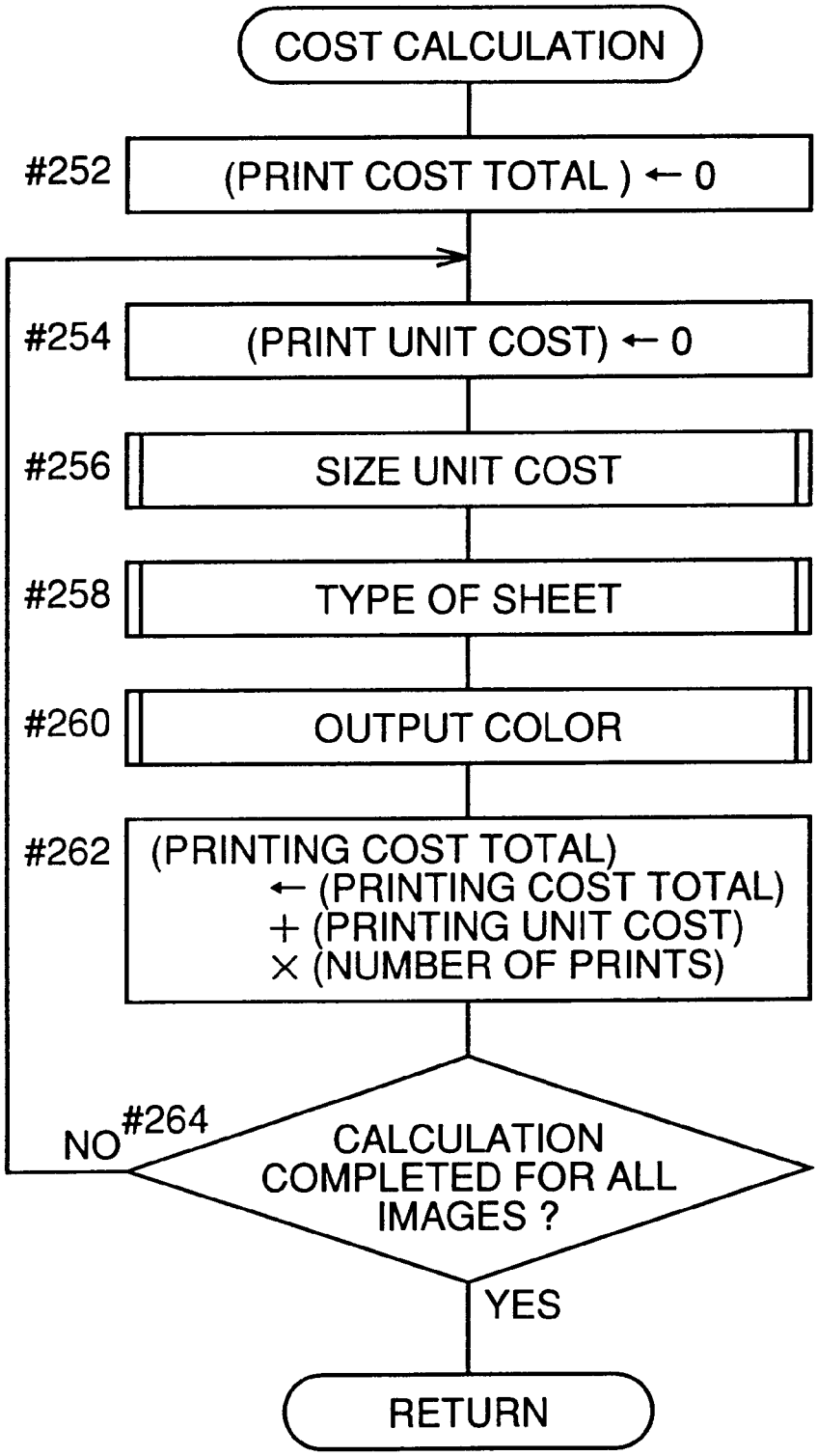
FIG. 29 is a flow chart showing the contents of a cost calculation process according to the second specific example.

FIG. 29 is a flow chart showing the contents of the cost calculation process of step #244 of FIG. 28.

Referring to FIG. 29, the total amount of printing cost PF is initialized to 0 (#252). The print unit cost which is the printing cost PF per sheet is initialized to 0 (#254). Then, a size unit cost process which is the calculation of the unit cost for a sheet size is carried out according to print condition PC designated by the user (#256). A sheet type process which is the unit cost calculation according to the type of the sheet is carried out (#258). Then, an output color process which is the unit cost calculation of a sheet according to the output colors is carried out (#260). Respective values are totaled to calculate printing cost PF (#262). When the calculation of printing cost PF for all image files PF is completed (#264; YES), the main routine ends.

Figure 30:
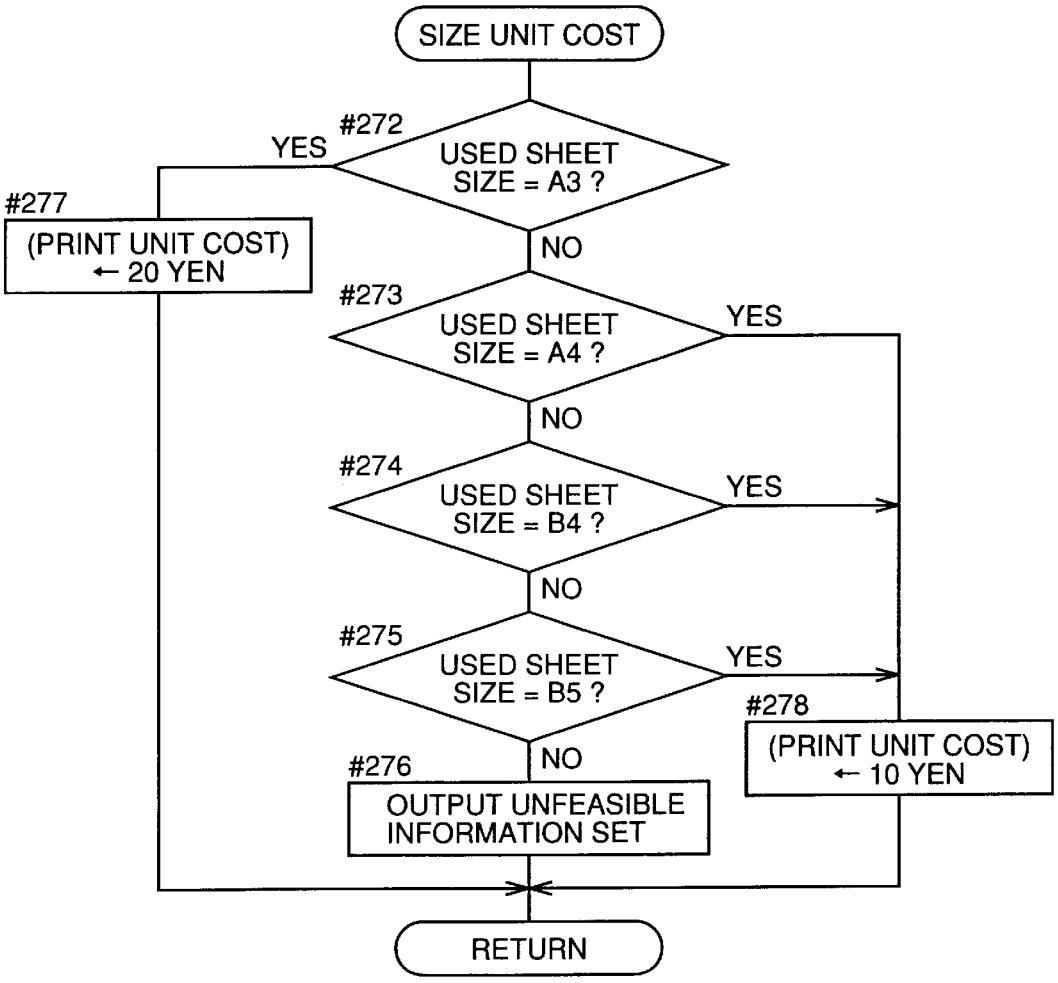
FIG. 30 is a flow chart showing the contents of a size unit cost process according to the second specific example.
Figure 31:
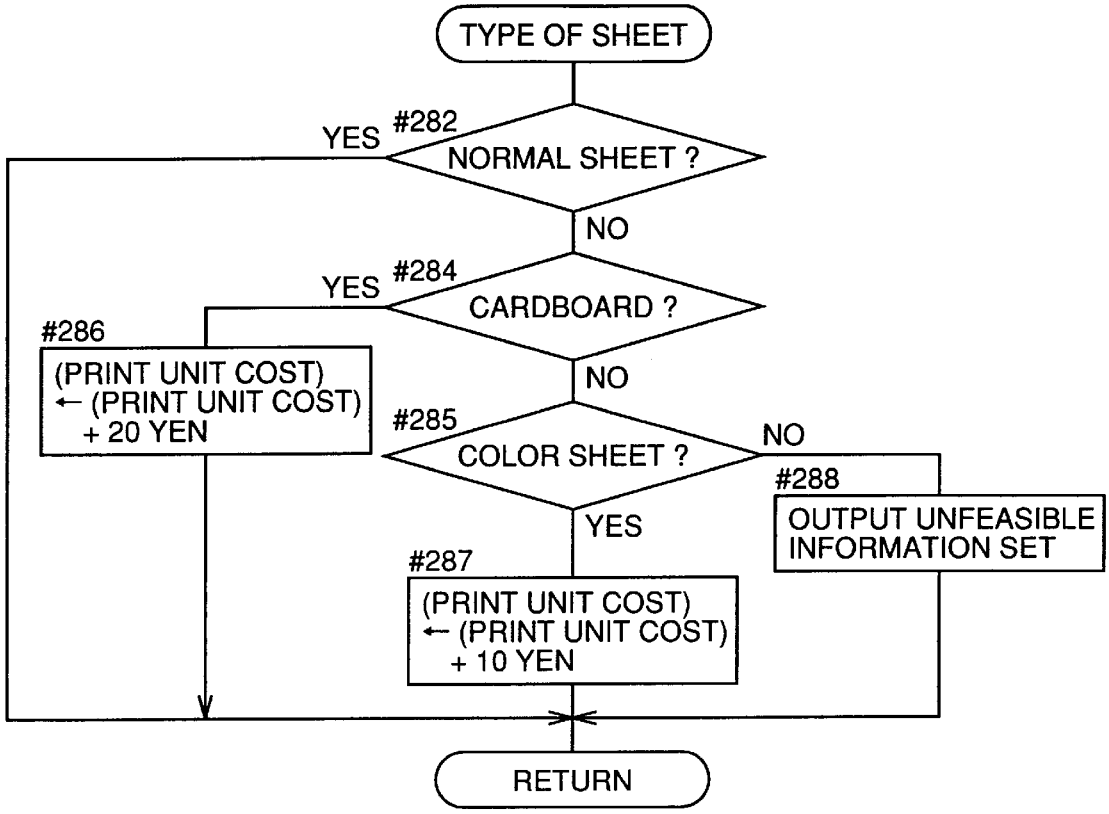
FIG. 31 is a flow chart showing the contents of a sheet type process according to the second specific example.
Figure 32:
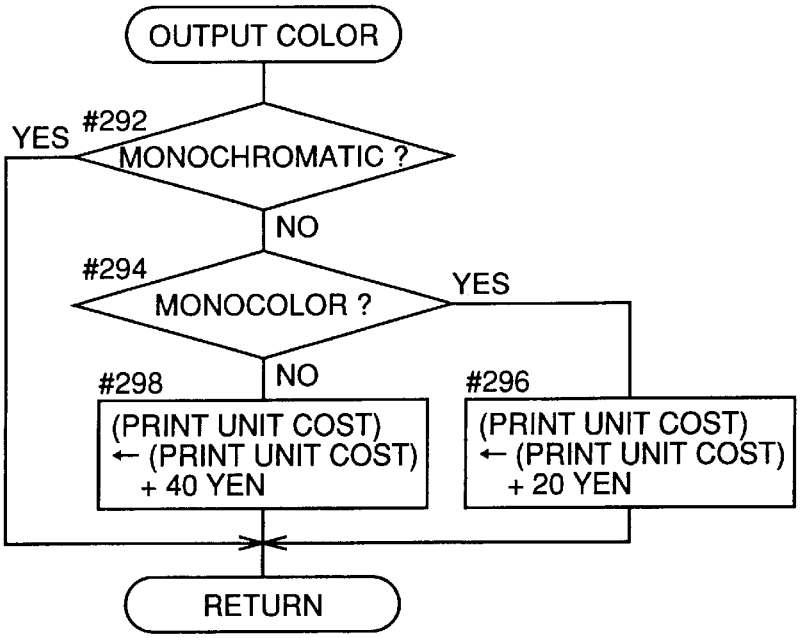
FIG. 32 is a flow chart showing the contents of an output color process according to the second specific example.

FIGS. 30, 31, and 32 are flow charts corresponding to steps #256, #258, #260, respectively, of FIG. 29.

According to the flow chart of FIG. 30, when the sheet size specified by the user is A3 (#272; YES), the print unit cost is set to, for example, 20 Japanese yen (#277). When the sheet size specified by the user is A4, B4, or B5(YES in any of steps #273–#275), the print unit cost is set to, for example, 10 yen (#278). When the sheet size specified by the user does not correspond to any of these sizes (NO in all steps #272–#275), output unfeasible information is set (#276).

According to the flow chart of FIG. 31, when the type of the sheet specified by the user is a normal sheet (#282; YES), the main routine ends. When the type of the sheet specified by the user is a cardboard (#284; YES), 20 yen, for example, is added to the unit cost (#286). When the type of the sheet specified by the user is a color sheet (#285; YES), 10 yen, for example, is added to the unit cost (#287). When the type of the sheet designated by the user is none of the above-mentioned type of sheets, (NO in all #282–#285), output unfeasible information NP is set (#288).

According to the flow chart of FIG. 32, when the output color specified by the user is monochromatic (#292; YES), the main routine ends. In the case of monocolor (#294; YES), 20 yen, for example, is added to the unit cost (#296). When neither applies (#292 and #294; NO), 40 yen, for example, is added to the unit cost (#298).

Figure 33:
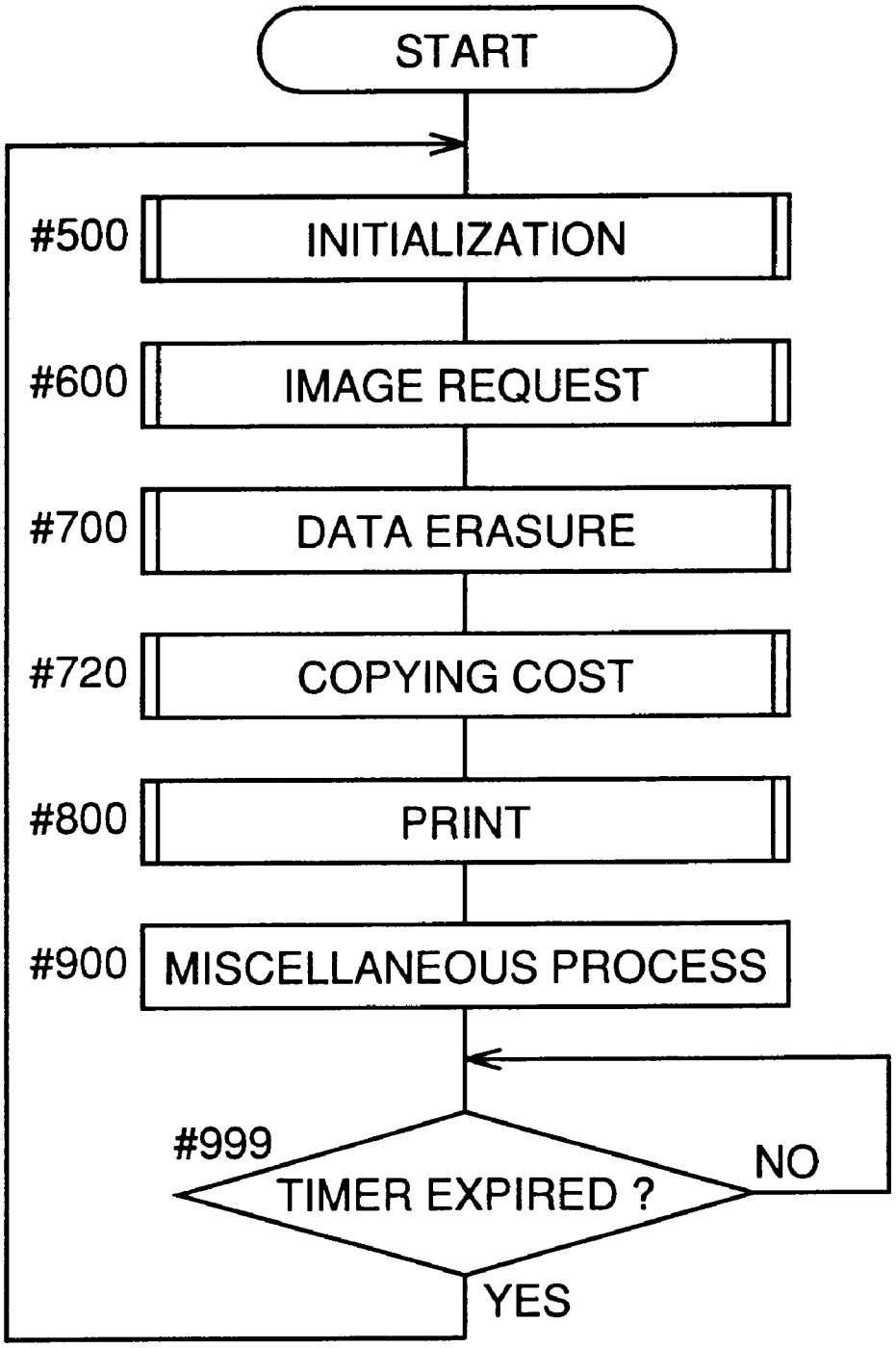
FIG. 33 is a flow chart showing the overall process of a copy machine according to the first specific example.

FIG. 33 is a flow chart showing the overall process of copy machine 3 according to a first specific example. The flowchart without the copy cost process of step #720 of FIG. 33 corresponds to the flow chart indicating the overall process of copy machine 3 of a second specific example.

Referring to FIG. 33, when copy machine 3 is powered on, initialization is carried out to set the timer defining the time of one routine (#500). Control proceeds to #600 to carry out an image request process of requesting image file DF to center side data processor 4.

Control proceeds to #700 to carry out a data erasure process of discarding the received image file DF. Control proceeds to #720 to carry out a copy cost process for calculating the expense of printing out image file DF. Control proceeds to step #800 to carry out the print process of receiving image file DF from center side data processor 4 and printing out the received image file DF. Then, control proceeds to #900 to carry out miscellaneous processes. When a predetermined time elapses (#999; YES), control returns to step #600.

Figure 34:
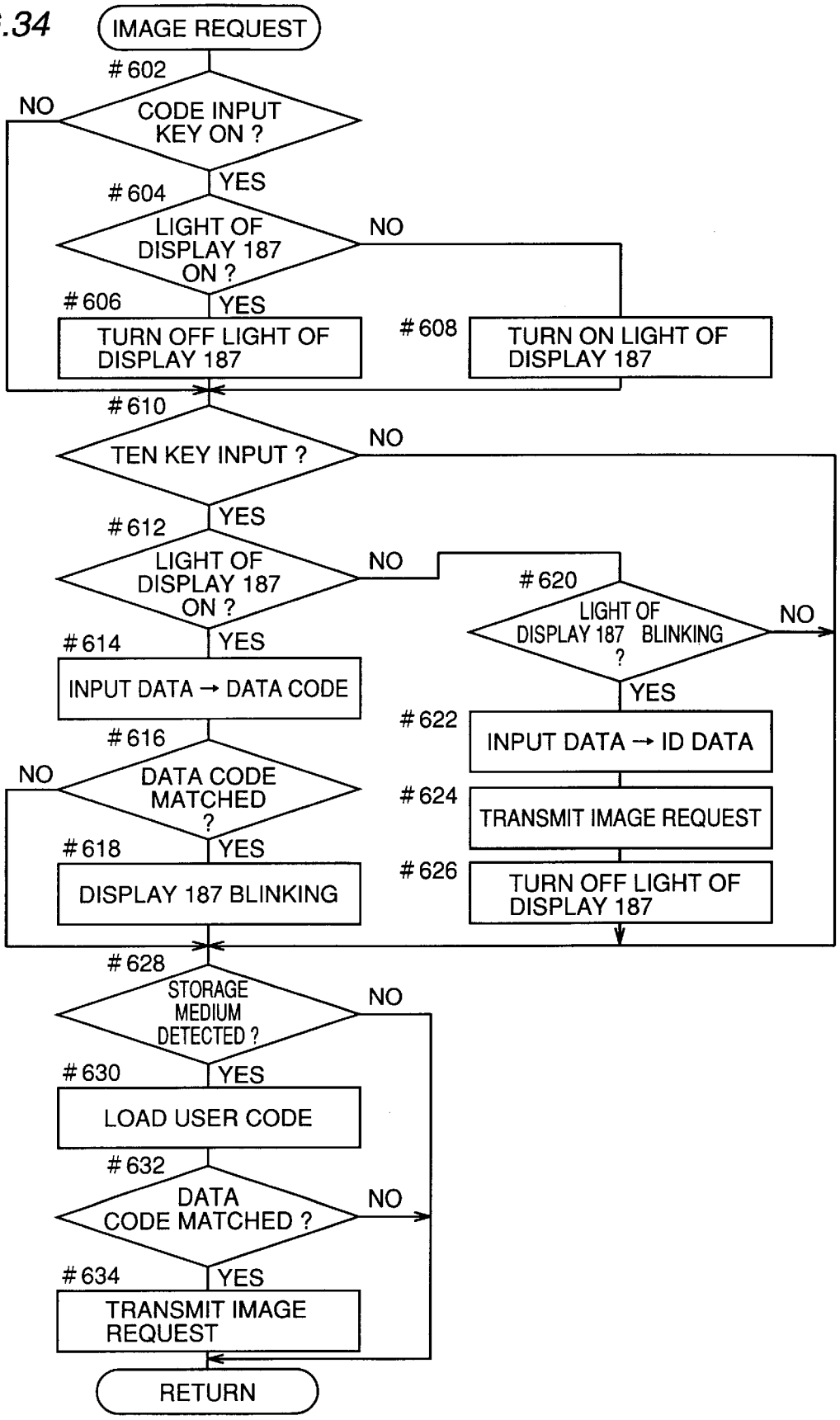
FIG. 34 is a flow chart showing the contents of an image request process.
Figure 35:
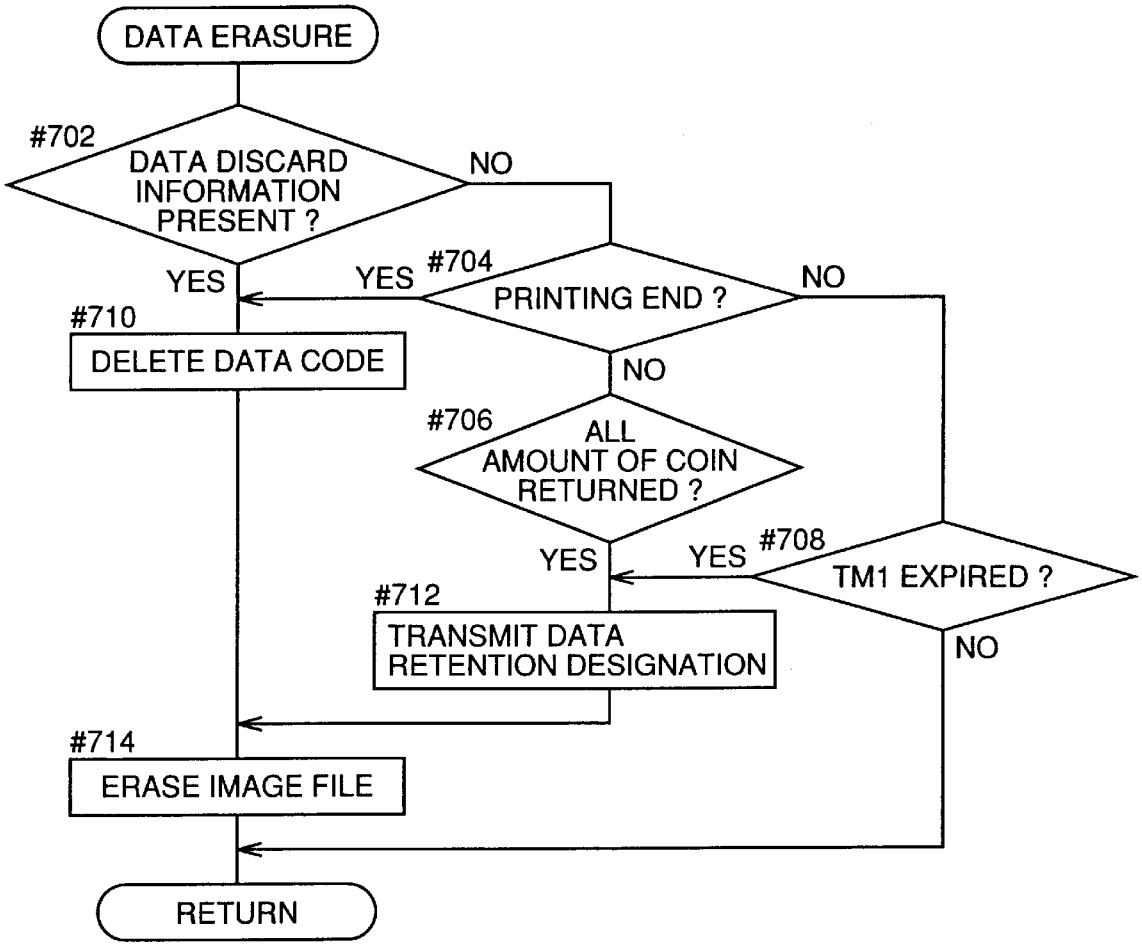
FIG. 35 is a flow chart showing the contents of a data erasure process.
Figure 41:
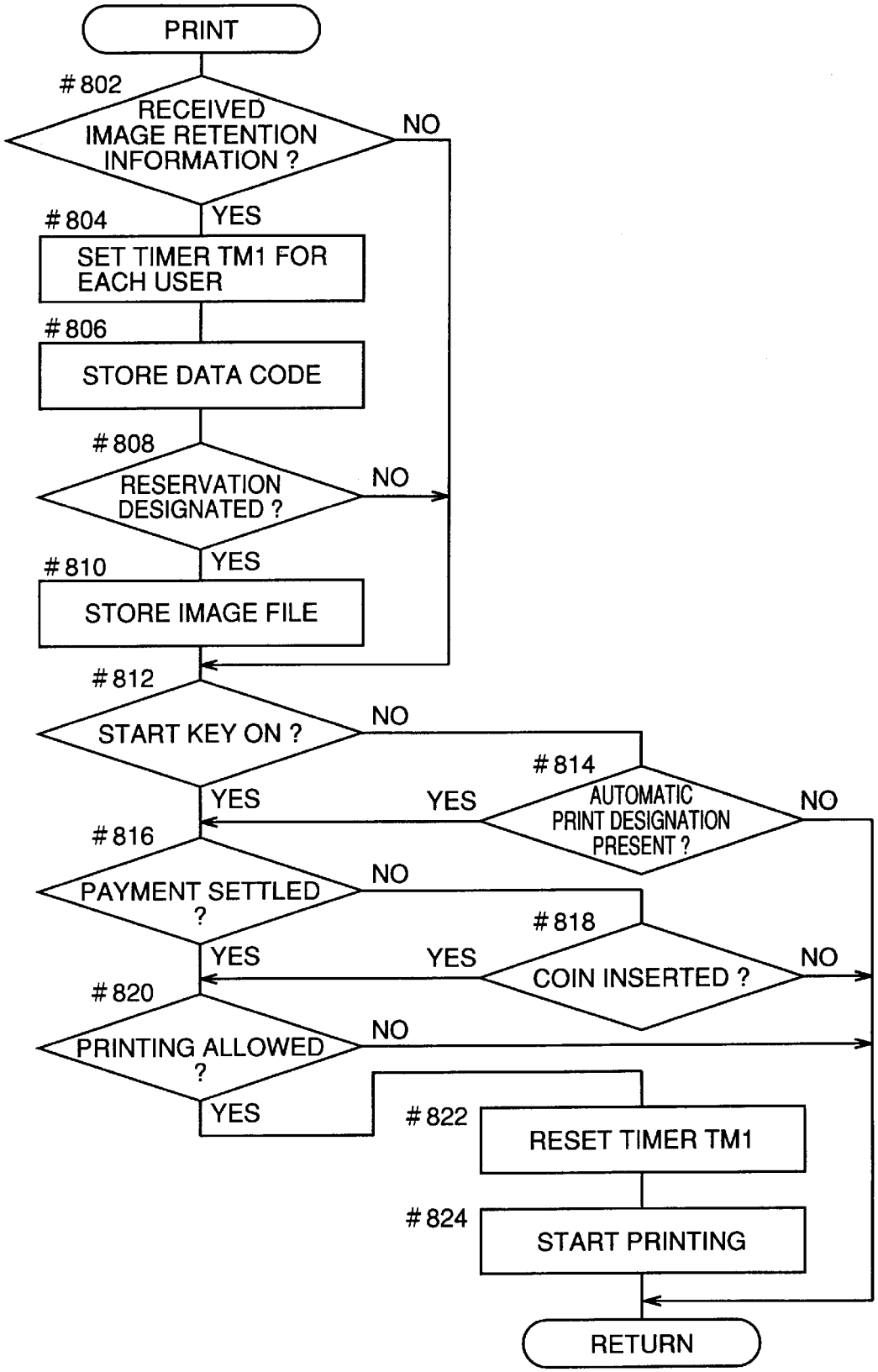
FIG. 41 is a flow chart showing the contents of a print out process.

FIGS. 34, 35 and 41 are flow charts showing the image request process, the data erasure process, and the print process, respectively. The flowcharts of the FIGS. 34, 35 and 41 are applicable to both the first and second specific examples.

These processes are carried out by executing program CP stored in memory 131 of copy machine 3.

According to the flow chart of FIG. 34, determination is made whether code input key 188 on operation panel 18 is depressed or not (#602). The light of display 187 is alternately turned on and off every time code input key 188 is depressed (#604, 606, 608). The mode of entering the user code, i.e., data code DC and ID code UC, is entered when the light of display 187 is ON.

When there is an input through ten key 181 (#610; YES), control proceeds to #612. When the light of display 187 is on (YES), control proceeds to #614 to store the input series of numbers into memory 131 as data code DC. The entered data code DC is checked. When there is a matching data code DC (#616; YES), the light of display 187 attains a blinking state (#618).

When there is an entry through ten key 181 during the blinking state of display 187 (#610; YES: #612; NO: #620; YES), the entered series of numerics is stored into memory 131 as ID code UC (#622). Then, control proceeds to #624 to transmit the image request to center side data processor 4. Then, the light of display 187 is turned off (#626).

When detection is made that recording medium MM1, 2 is set at storage medium reader device 39 (#628), data code DC and ID code UC are loaded from storage medium MM1, 2 (#630). The loaded data code DC is checked to see whether there is a matching data code DC (#632; YES). Then, control proceeds to #634 to send an image request to center side data processor 4.

Referring to FIG. 35, determination is made whether data discard information is received from center side data processor 4 (#702). When data discard information is received, data code DC stored in memory 131 is deleted from copy machine 3 (#710) based on the assumption that printing is no longer intended since printing was not executed within a predetermined time or period (for example, several days) despite the user once requesting printout. Then, image file DF corresponding to data code DC, if held in memory 131, is also deleted (#714).

When data discard information is not received at step #702, determination is made whether the complete printing operation by copy machine 3 is ended or not (#704). When the entire printing operation is completed, data code DC is deleted at step #710. When the printing operation has not yet been completed, control proceeds to #706 to determine whether all the inserted coins are returned or not. Assumption is made that the printing has been interrupted prior to completing the entire printing when all the coins are returned. Control proceeds to #712 to issue a data retention instruction to defer from erasing immediately image print information PD to center side data processor 4.

When the coin return operation is not effected at step #706, control proceeds to #708 to determine whether the time counted by timer TM1 after receiving data code DC from center side data processor 4 elapsed or not. When the count time is exceeded, a data retention instruction is transmitted at step #712 on the assumption that the printing is left in an interrupted manner.

Figure 36:
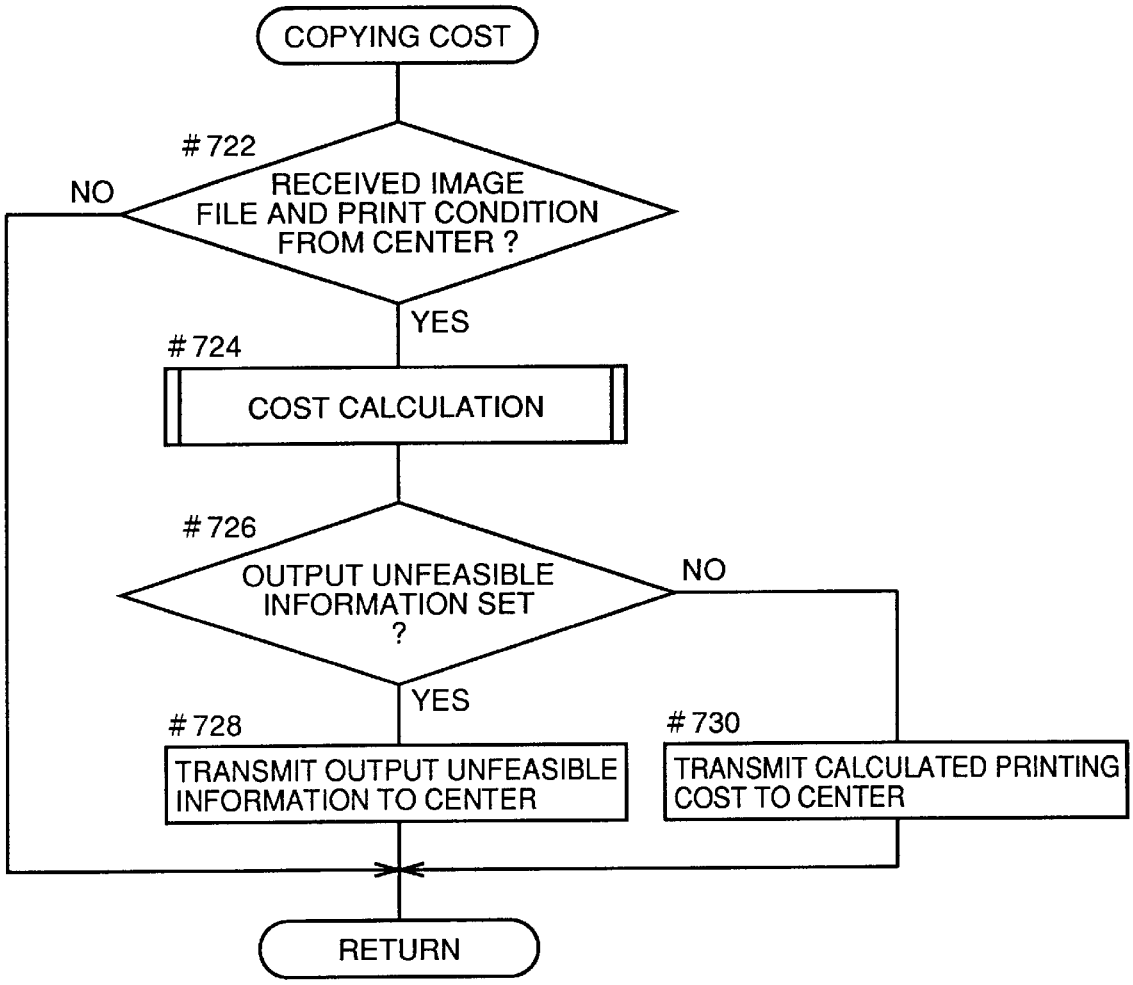
FIG. 36 is a flow chart showing the contents of a copy cost process according to the first specific example.

FIG. 36 is a flow chart showing the contents of a copy cost process of step #720 of FIG. 33.

Referring to FIG. 36, when image file DF and print condition PC are received from center side data processor 4 (#722; YES), the cost calculation process is carried out (#724). Control proceeds to step #726 to determine whether output unfeasible information NP is set or not. When output unfeasible information NP is set (#726; YES), output unfeasible information NP is transmitted to center side data processor 4 (#728).

When output unfeasible information NP is not set (#726; NO), the calculated printing cost PF is transmitted to center side data processor 4 (#730).

Figure 37:
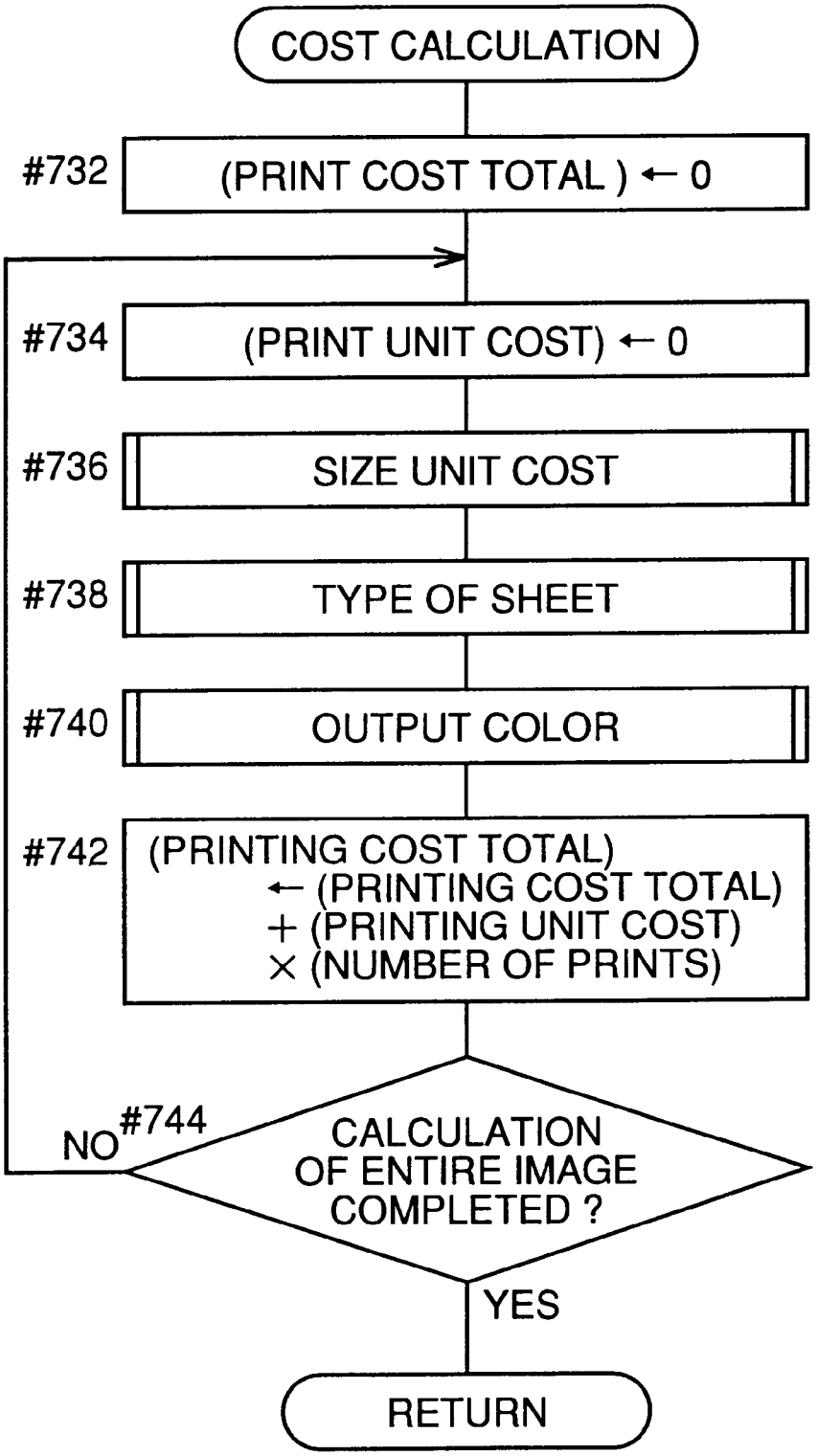
FIG. 37 is a flow chart showing the contents of a cost calculation process according to the first specific example.

FIG. 37 is a flow chart showing the contents of the cost calculation process of step #724 of FIG. 36.

Referring to FIG. 37, the total amount of printing cost PF is initialized to 0 (#732). Also, the print unit cost which is the printing fee PF per sheet is initialized to 0 (#734). Control proceeds to #736 to carry out a size unit cost calculation which is the calculation of the unit cost for each sheet size according to print condition PC specified by the user. Then, a sheet type process which is calculation of the unit cost according to the type of the sheet is carried out (#738). Then, an output color process is carried out which is the calculation of the unit cost of a sheet according to the output color (#740). These values are totaled to obtain printing cost PF (#742). When calculation of printing cost PF for all image files DF is completed (#744; YES), the main routine ends.

Figure 38:
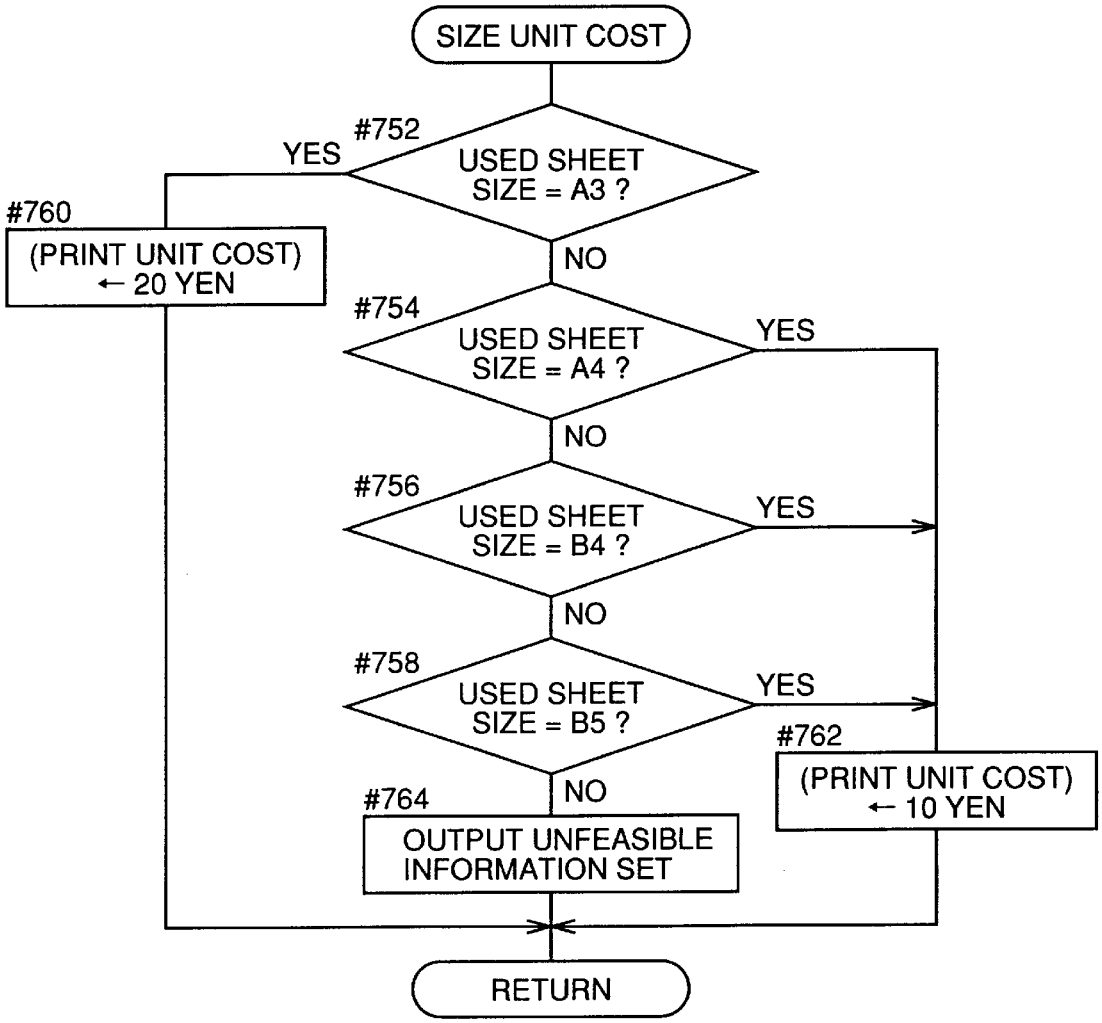
FIG. 38 is a flow chart showing the contents of a size unit cost process according to the first specific example.
Figure 39:
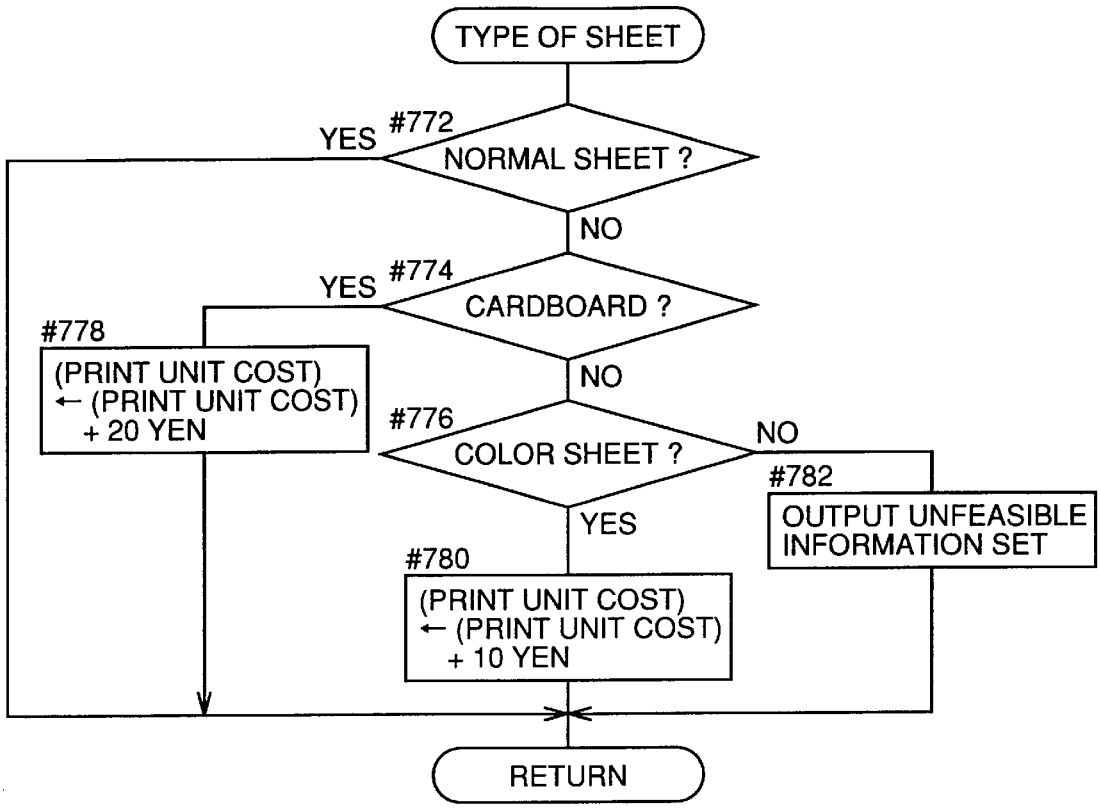
FIG. 39 is a flow chart showing the contents of a sheet type process according to the first specific example.
Figure 40:
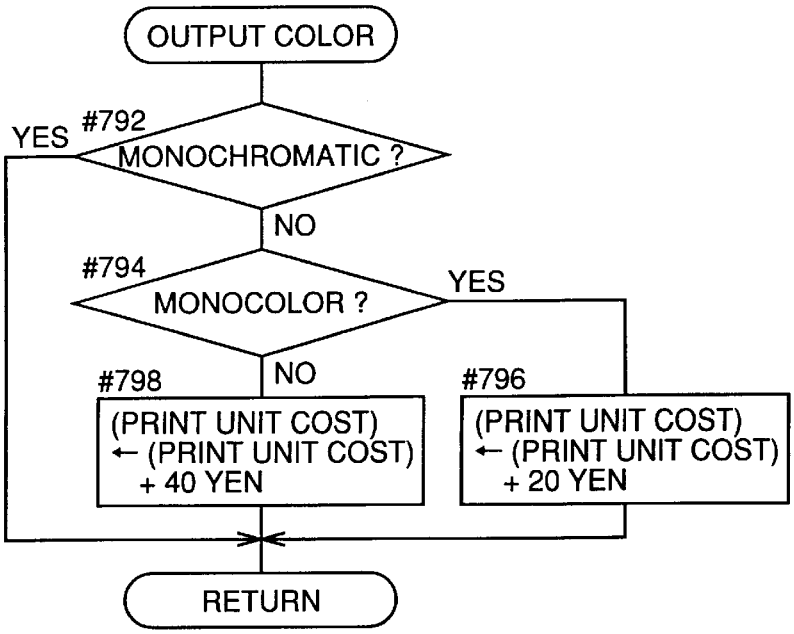
FIG. 40 is a flow chart showing the contents of an output color process according to the first specific example.

FIGS. 38, 39, and 40 are flowcharts corresponding to step #736, step #738, and step #740 of FIG. 37, respectively.

Referring to FIG. 38, when the size of the sheet specified by the user is A3 (#752; YES), the print unit cost is set to, for example, 20 yen (#760). When the specified sheet size is either A4, B5, or B5 (YES in any of #754–758), the print unit cost is set to, for example, 10 yen (#762). When the sheet size specified by the user does not match any of the aforementioned sizes (NO in all #752–758), output unfeasible information NP is set (#764).

Referring to FIG. 39, when the type of the sheet specified by the user is a normal sheet (#772; YES), the main routine ends. When the type of the specified sheet is a cardboard (#744; YES), 20 yen, for example, is added to the print unit cost (#778). When the specified sheet is a color sheet (#776; YES), 10 yen, for example, is added to the print unit cost (#780). When the type of the sheet specified by the user is neither a general sheet, a cardboard, nor a color sheet (NO in #772–776), output unfeasible information NP is set (#782).

Referring to FIG. 40, when the output color specified by the user is monochromatic (#792; YES), the main routine ends. When the specified output color is monocolor (#794; YES), 20 yen, for example, is added to the print unit cost (#796). When neither of the case applies (NO in both #792 and #794), 40 yen, for example, is added to the print unit cost (#798).

Referring to FIG. 41, determination is made whether image retention information and data code DC are received from center side data processor 4 (#802). When the image retention information and data code DC are received, timer TM1 for counting the time before erasing the image data for each user is set, and the counting is initiated (#804). The received data code DC is stored in memory 131 (#806). Data code DC stored in memory 131 is compared with data code DC entered by the user at copy machine 3.

When information of reservation date RD is included in the received data (#808; YES), the received image file DF is stored in memory 131 (#810).

Then, determination is made whether start key 186 of operation panel 18 is depressed by the user at the site of copy machine 3 (#812). When start key 186 is depressed, control proceeds to #816 to determine whether the charge is already transferred (YES), or the required amount of coin is inserted into coin inlet 222 (#818; YES). When all the other printing conditions are completed (#820; YES), the relevant timer TM1 is reset (#822). Then, the print execution is initiated (#824).

When start key 186 is not depressed at step #812, determination is made whether an automatic print designation is received from center side data processor 4 (#814). When automatic print designation is received, the process of steps #816 and et seq. are executed.

Figure 42:
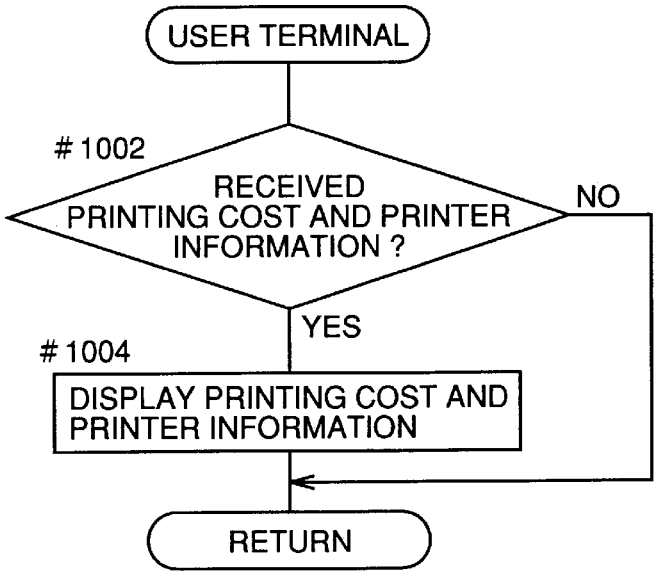
FIG. 42 is a flow chart showing the contents of a display process in the user side data processor.
Figure 43:
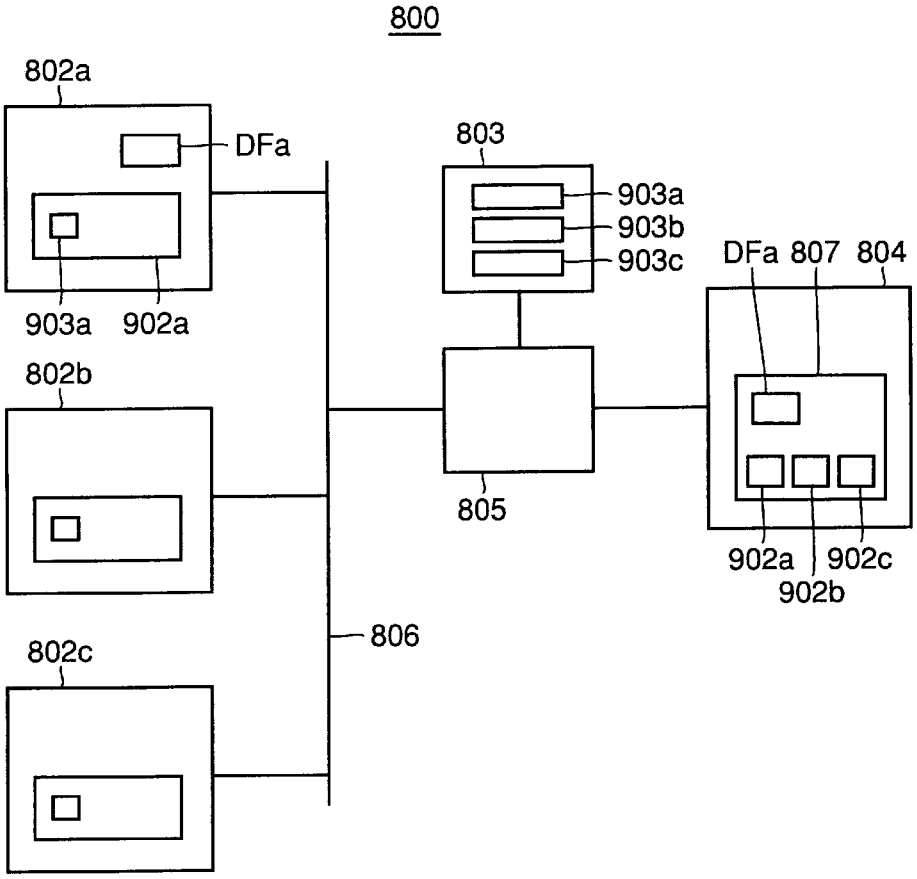
FIG.43 PRIOR ART
FIG. 43 is a block diagram schematically showing a conventional printing system.

FIG. 42 is a flow chart showing the contents of a display process at user side data processor 5.

Referring to FIG. 42, when printing cost PF and printer information PI are received from center side data processor 4 (#1002; YES), printing cost PF and printer information PI are provided on display 51 (#1004).

Since the user can set print condition PC at user side data processor 5, it is not necessary to manually set print condition PC at copy machine 3 in the above embodiment. Therefore, the time required for manipulation or caused by erroneous operation by a user unfamiliar with the manual operation of copy machine 3 can be prevented.

Since printing cost PF can be identified before print out is executed at copy machine 3, the user can alter the print condition PC when printing cost PF is too high. Furthermore, the problem of shortage of the amount for payment can be eliminated in paying the printing cost FP at the installed site of copy machine 3.

Printer information PI including the information of a copy machine that allows printout according to print condition PC is provided on display 51. Therefore, even in the case where printing cannot be carried out under the print condition PC specified by the user due to absence of a relevant feature in copy machine 3, the user can select a copy machine that satisfies the desired print condition PC from printer information PI. Therefore, a printout according to the desired print condition PC can be reliably obtained when the user goes to the installed site of the relevant copy machine 3.

In the above embodiments, center side data processor 4 and copy machine 3 can be connected by a common network including user side data processor 5. It is also possible to connect center side data processor 4 and copy machine 3 by an individual private line independent to the network connecting center side data processor 4 and user side data processor 5. Also, one center side data processor 4 can be provided for one copy machine 3 and connection established therebetween. When the user requests printing from user side data processor 5, image print information PD can be transmitted in advance to center side data processor 4 corresponding to the connected copy machine 3 that carries out printing. Alternatively, copy machine 3 and center side data processor 4 can be implemented integrally. Printing system 1 can be implemented as a client server system.

In this case, the user side data processor is the client and the center side data processor is the server. The printer is connected to the server.

In the above embodiments, the program for implementing the printing system is stored in the hard disk of the data processor. Alternatively, the data processor can read the recording medium incorporating the program for implementing the printing system to achieve the above feature using a general purpose computer.

Although a digital type copy machine 3 for printing image file DF is employed in the above embodiments, a single printer device can be used. More specifically, a printer device of high performance can be connected to center side data processor 4 for usage. Furthermore, various printer devices that allow print out of image file DF such as a device with facsimile function can be employed.

In the above embodiments, the structure, circuitry, function, operation method, process contents, and sequence of user side data processor 5, center side data processor 4, and copy machine 3 can be modified appropriately. Also, the contents, sequence, and division of the process of respective flow charts can be modified appropriately according to the concept of the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing system comprising:

input means for entering a print job, calculation means for calculating printing cost according to said input print job, display means for displaying the calculated printing cost prior to execution of the print job, and control means for allowing modification of the print job after the calculated printing cost is displayed, and permitting a printing operation after confirming that there is no modification in the print job.

2. The printing system according to claim 1, further comprising a document tray on which a document for print out is mounted, wherein said input means reads out the document set on said document tray for obtaining data of the size and color of said document.

3. A printing system comprising:

a user side data processor transmitting a data file that a user wishes to print out;

a center side data processor connected to said user side data processor by a communication line, and having a memory device for storing the data file transmitted from said user side data processor; and a printer connected to said center side data processor for printing out the data file transmitted from said center side data processor, wherein said printer includes first printing cost information transmission means for calculating printing cost information, which is information of cost corresponding to execution of printing out said data file, and transmitting the calculated printing cost information to said center side data processor prior to execution of printing out said data file, and said center side data processor includes second printing cost information transmission means for transmitting the calculated printing cost information received from said printer to said user side data processor, also prior to execution of printing out said data file.

4. The printing system according to claim 3, wherein said first printing cost information transmission means sends said printing cost information to said center side data processor only when determination is made that execution of printing out said data file is allowed by said printer.

5. The printing system according to claim 4, wherein said data file includes at least image data and print mode data for specifying print condition of said image data.

6. The printing system according to claim 3, wherein said data file includes at least image data and print mode data for specifying print condition of said image data.

7. The printing system according to claim 3, wherein said printer is directly connected to said center side data processor, and required data or information is sent in advance to the center side data processor of the printer that is to carry out printing when a user requests printing of said data file via said user side data processor.

8. The printing system according to claim 3, wherein said printer and said center side data processor are formed integrally.

9. The printing system according to claim 3, wherein said center side data processor or said printer includes a display.

10. The printing system according to claim 3, wherein said user side data processor includes a display, said user side data processor providing received printing cost information on said display.

11. The printing system according to claim 3, wherein said printer is a printer provided in a digital copy machine.

12. A printing system employing a communication line, comprising:

a user side data processor for transmitting a data file that a user wishes to print out;

a center side data processor connected to said user side data processor by the communication line, and having a memory device for storing the data file transmitted from said user side data processor; and a printer connected to said center side data processor for printing out the data file transmitted from said center side data processor, wherein said center side data processor includes printing cost calculating means for calculating printing cost information, which is information of the cost corresponding to execution of printing out said data file, prior to execution of printing out said data file, and printing cost information transmission means for transmitting the calculated printing cost information to said user side data processor, also prior to execution of printing out said data file.

13. The printing system employing a communication line according to claim 12, wherein a plurality of said printers are provided, and wherein said printing cost calculation means calculates said printing cost information for each of said plurality of printers connected to said center side data processor.

14. The printing system employing a communication line according to claim 13, wherein said data file includes at least image data and print mode data for specifying printing condition of said image data.

15. The printing system employing a communication line according to claim 12, wherein said printing cost calculation means calculates only executable printer cost information which is the printing cost information for a printer that allows execution of printing out said data file, wherein said printing cost information transmission means is formed to transmit only said executable printer cost information to said user side data processor.

16. The printing system employing a communication line according to claim 15, wherein said data file includes at least image data and print mode data for specifying printing condition of said image data.

17. The printing system employing a communication line according to claim 12, wherein said data file includes at least image data and print mode data for specifying printing condition of said image data.

18. The printing system employing a communication line according to claim 12, wherein one center side data processor is provided corresponding to one printer and connection established therebetween, wherein required data or information is transmitted in advance to the center side data processor of the printer that carries out printing when a user requests printing through the user side data processor.

19. The printing system employing a communication line according to claim 12, wherein said printer and said center side data processor are formed integrally.

20. The printing system employing a communication line according to claim 12, wherein said center side data processor or said printer includes a display.

21. The printing system employing a communication line according to claim 12, wherein said user side data processor includes a display, said user side data processor providing received printing cost information on said display.

22. The printing system employing a communication line according to claim 12, wherein said printer is a printer provided in a digital type copy machine.

23. A printing method comprising the steps of:

entering a print job, calculating printing cost according to said input print job, displaying the calculated printing cost prior to execution of the print job, and allowing modification of the print job after the calculated printing cost is displayed, and permitting a printing operation after confirming that there is no modification in the print job.

24. A printing method for a client processor, a central processor and a printer connected together via a communication line and used in a client-server type network system, comprising the steps of:

transmitting data to be printed from the client processor to the central processor via the communication line;

storing the data to be printed in the central processor and calculating a cost required for printing the data to be printed;

transmitting the calculated cost to the client processor prior to printing the data to be printed.

25. A printing method for a client processor, a central processor and a printer connected together via a communication line and used in a client-server type network system, comprising the steps of:

transmitting data to be printed from the client processor to the central processor via the communication line;

storing the data to be printed in the central processor and transmitting the data from the central processor to the printer via the communication line;

storing the data transmitted from the client processor in the printer;

calculating the cost required for printing the data to be printed stored in said printer; and transmitting the calculated cost to the central processor and from the central processor to the client processor prior to printing the data to be printed.

26. A computer program product for a client-server type printing system network including a client processor, a central processor and a printer connected together via a communication line including, said computer program product having a computer readable medium with computer program logic recorded thereon for enabling said printing system to:

transmit data to be printed from the client processor to the central processor via the communication line;

store the data to be printed in the central processor and transmit the data from the central processor to the printer via the communication line;

store the data transmitted from the client processor in the printer;

calculate a cost required for printing the data to be printed, stored in said printer; and transmit the calculated cost to the client processor prior to printing the data to be printed.

27. A computer program product for a client-server type printing system network including a user processor, a central processor and a printer connected together via a communication line including, said computer program product having a computer readable medium with computer program logic recorded thereon for enabling said printing system to:

transmit data to be printed from the client processor to the central processor via the communication line;

store the data to be printed in the central processor and calculate a cost required for printing the data to be printed; and transmit the calculated cost to the client processor prior to printing the data to be printed.

28. The printing system according to claim 1, further comprising means for determining whether an original is a color original or a monochrome original based on data read by reading the image of the original, wherein said calculating means calculates printing costs by referring to the result of said determining means.

* * * * *